US007148472B2

(12) United States Patent
Glukhoy

(10) Patent No.: US 7,148,472 B2
(45) Date of Patent: Dec. 12, 2006

(54) AEROSOL MASS SPECTROMETER FOR OPERATION IN A HIGH-DUTY MODE AND METHOD OF MASS-SPECTROMETRY

(75) Inventor: Yuri Glukhoy, Irwin, PA (US)

(73) Assignee: NGX, Inc., North Huntingdon, PA (US)

( * ) Notice: Subject to any disclaimer, the term of this patent is extended or adjusted under 35 U.S.C. 154(b) by 26 days.

(21) Appl. No.: 10/789,555

(22) Filed: Feb. 28, 2004

(65) Prior Publication Data

US 2005/0189484 A1 Sep. 1, 2005

(51) Int. Cl.
*H01J 49/40* (2006.01)

(52) U.S. Cl. ..... 250/287; 250/282; 250/288

(58) Field of Classification Search ..... 250/287
See application file for complete search history.

(56) References Cited

U.S. PATENT DOCUMENTS

| | | | | |
|---|---|---|---|---|
| 5,396,065 | A | 3/1995 | Myerholtz et al. | |
| 5,719,392 | A * | 2/1998 | Franzen | 250/282 |
| 5,753,909 | A | 5/1998 | Park et al. | |
| 6,107,625 | A | 8/2000 | Park | |
| 6,198,096 | B1 * | 3/2001 | Le Cocq | 250/287 |
| 6,300,626 | B1 | 10/2001 | Brock et al. | |
| 6,524,803 | B1 | 2/2003 | Overney et al. | |
| 6,623,935 | B1 * | 9/2003 | Overney et al. | 435/7.1 |
| 6,661,001 | B1 * | 12/2003 | Park | 250/287 |
| 6,664,545 | B1 * | 12/2003 | Kimmel et al. | 250/396 R |
| 6,870,157 | B1 * | 3/2005 | Zare | 250/287 |
| 2005/0119868 | A1 * | 6/2005 | Scheidemann et al. | 702/196 |

OTHER PUBLICATIONS

U.S. Appl. No. 10/058,153, filed Jan. 29, 2002, Yuri Glukhoy.
"Industrial Plasma Engineering" by Reece Roth, vol. 1, Institute of Physics Publishing, Bristol and Philadelphia, 1992, pp. 206-218.

* cited by examiner

*Primary Examiner*—Kiet T. Nguyen
*Assistant Examiner*—James J. Leybourne
(74) *Attorney, Agent, or Firm*—Debra M. Parrish

(57) ABSTRACT

An aerosol TOF MS of the present invention is based on the use of quadrupole lenses with angular gradient of the electrostatic field. On the entrance side, the TOF MS contains an ion-optic system that is used for focusing, aligning, and time-modulating the ionized flow of particles and a deflector modulator that provides alternating deflections of the flow of particles between two positions for aligning the flow with two inlet openings into the TOF MS. As a result, two independently analyzed discrete flows of particles pass through the ion mass separation chamber of the TOF MS without interference with each other. The charged particles fly in direct and return paths along helical trajectories which extend the length of the flight time. The time of the collision and the magnitude of the collision pulse will contain information about the M/Z ratio for the particles being registered. Multiplication of a single flow of particles into a plurality of independent and spatially separated flows propagating in one chamber increases efficiency of the TOF MS and makes it possible to use it in continuous and high-duty applications with the duty cycle as high as 98%, which is unattainable with any known device of this class.

29 Claims, 13 Drawing Sheets

AEROSOL MASS SPECTROMETER FOR OPERATION IN A HIGH-DUTY MODE AND METHOD OF MASS-SPECTROMETRY

FIELD OF THE INVENTION

The present invention relates to the field of measurement instruments, in particular to mass spectrometers used for analyses of substances based on results of determination of masses of their charged particles or spectra of masses. More specifically, the invention relates to time-of-flight aerosol mass spectrometers for operation in a high-duty mode with high resolution and sensitivity. The invention also relates to a method of mass spectrometry for continuous analysis of particles in a wide range of types and dimensions.

BACKGROUND OF THE INVENTION

An important aspect of environmental control is monitoring the Earth's atmosphere and water basins. Atmospheric aerosols that are contained in the Earth's atmosphere play important roles in climatology and visibility as they absorb and scatter solar radiation. They also may affect human health when they penetrate the human body via the respiratory tracts. Therefore, there have been increased efforts aimed at better characterization of chemical and microphysical properties of aerosols to help elaborate appropriate particulate matter emission standards. Understanding of properties and behavior of atmospheric aerosols is also extremely important for studying the Earth's climate and potential detrimental impact of the aerosols on air quality and human health.

Control of water consists of flow routing along the river network, especially in connection with human activity, surveying of hydrological processes of land-atmospheric interaction such as evapotranspiration and snowmelt, control of sediment and pollutant transport in the streams, etc. It is not less important to control the pollution of water in seas and oceans, especially in the populated coastal areas. The protection of the water supplies is an important goal also for Homeland Defense to prevent a pandemic disaster. A future terrorist tactic could include dispersing of the poison-containing ampoules that can be triggered by remote control. The ampoules could be dispersed in air as aerosols or moved invisibly underwater and put in the bottom of the reservoir.

An instrument, which is normally used, for controlling environmental conditions of water and gases is an aerosol mass spectrometer. Irrespective of whether the samples are taken from water or air, a mass spectrometer per se operates with dry particles or dried particles. In the case when samples are taken from water, prior to admission into the vacuum chamber of the mass spectrometer, the samples are pretreated to form a stream of dried discrete particles. The samples are dried even if they are taken from moisture-containing air. Since the present invention relates to an aerosol mass spectrometer and since the particles or particles enter the mass spectrometer already in a dry state, the following analysis of the prior art will relate merely to aerosol mass spectrometers without distinction between those taking samples from water or the atmosphere.

A typical aerosol mass spectrometer consists of the following parts: a sample inlet unit with a system for preparation and introduction of a substance to be analyzed into the instrument; a source of particles; an ionization device where the aforementioned particles are charged and formed into an charged particle flow; a mass analyzer where the charged particles are separated in accordance with an M/Z ratio, focused, and are emitted from the particle source in various directions within a small space angle; a charged-particle receiver or collector where current of charges is measured or converted into electrical signals; and a device for amplification and registration of the output signal. In addition to amount of charged particles (ion current), the registration unit also receives information about charged particle mass. Other units included into a mass spectrometer are power supplies, measurement instruments, and a vacuum system. The latter is required for maintaining the interior of the mass spectrometer under high vacuum, e.g. of about $10^{-3}$ to $10^{-7}$ Pa. Operation is normally controlled by a computer, which also stores the acquired data. According to common understanding, ions are defined as charged atoms or molecules of a substance. However, since the aerosol mass spectrometer of the present invention works not only with ions but also with larger particles that may be aggregated from thousands or more than thousands of molecules, where appropriate, instead of the word "ion", we will use the word "particle" which covers both the ions and particles larger than ions. In some instances, the word "ion" will be still used in compliance with the generally used terminology. For example, the word "ion" is present in the words "ionizer" and "ionization".

The particles contain organic and inorganic compounds and elemental carbon black, graphite-like material. The particle-phase compounds can be divided into primary and secondary. The primary particulate compounds are of a particle origin, while the secondary compounds results from emission of gases, which then underwent chemical transformation in the atmosphere and condensed on the pre-existing particles. Primary and secondary compounds are emitted by both natural (sea salt from oceans, isoprene from plants) and anthropogenic sources (soot and organics from combustion sources, ammonia from cattle feedlots, etc.). Whether the gas-phase organics are natural or anthropogenic, many can react photochemically in the atmosphere usually by one of three paths: Photons cleave a bond, OH radicals abstract a hydrogen, or ozone reacts with a carbon-carbon double bond. This initial step is often followed by a chain of rapid reactions until a more stable molecule results. Reactions with ozone often produce oxygenated compounds with much lower vapor pressures than the parent compound. That is, the parent compound had a high vapor pressure so was in the gas phase. The daughter compound has a lower vapor pressure so condenses on pre-existing particles forming SOA (Secondary Organic Aerosol). The lower vapor pressure often comes from a compound that became water soluble (polar).

In fact, the aforementioned microparticles may appear to be extremely dangerous even if their concentration in air or water is insignificant. A good example of such dangerous substances is organic poison, such as ricin, or the like. Such dangerous substances in small concentrations can be localized in small areas, which are separated by vast non-polluted spaces, and, in order to detect the presence of such substances, it is necessary to scan these vast spaces with high rate and in a continuous high-duty mode of analysis, in order not to miss the aforementioned areas of poison localization.

In view of the above, there is a demand for development of real-time aerosol detection methods and apparatuses that would allow not only estimate mass and speciation of organic matter as a function of size but also quickly evaluate the photochemical evolution of the organic aerosol or identify isotopic and molecular-level tracers of primary and secondary organic carbon in a continuous high-duty mode of analysis.

A mass spectrometer is characterized by its resolution capacity, sensitivity, response, and a range of measured masses. The aforementioned response is a minimal time required for registration of mass spectrum without the loss of information within the limits of so-called decade of atomic mass units (1–10, 10–100, etc.). Normally such time is 0.1 to 0.5 sec. for static mass spectrometers and $10^{-3}$ for dynamic (time-of-flight) mass spectrometers.

A substance to be analyzed is introduced into the mass spectrometer with the use of so-called molecular or viscous flow regulators, load ports, etc.

By methods of ionization, ion sources of mass spectrometers can be divided into various categories, which are the following: 1) ionization caused by collisions with electrons; 2) photo-ionization; 3) chemical ionization due to ionic-molecular reactions; 4) field ion emission ionization in a strong electric field; 5) ionization due to collisions with ions; 6) atomic-ionization emission due to collisions with fast atoms; 7) surface ionization; 8) spark discharge in vacuum; 9) desorption of ions under effect of laser radiation, electron beam, or products of decomposition of heavy nuclei; and 10) extraction from plasma.

In addition to ionization, in mass spectrometer an ion source is used also for forming and focusing an ion beam.

More detail general information about types and constructions of ion sources suitable for use in mass spectrometers can be found in "Industrial Plasma Engineering" by Reece Roth, Vol. 1, Institute of Physics Publishing, Bristol and Philadelphia, 1992, pp. 206–218.

By types of analyzers, mass spectrometers can be divided into static and dynamic. Static mass spectrometers are based on the use of electric and magnetic fields, which remain, during the flight of charged particles through the chamber, practically unchanged. Depending on the value of the M/Z ratio, the charged particles move along different trajectories. More detailed description of static and dynamic mass spectrometers is given in pending U.S. patent application Ser. No. 10/058,153 filed by Yu. Glukhoy on Jan. 29, 2002.

It should be noted that static mass spectrometers are static installations, which are heavy in weight, complicated in construction, and operation with them requires the use of skilled personnel.

In time-of-flight mass spectrometers, charged particles formed in the ionizer are injected into the analyzer via a grid in the form of short pulses of charged-particle current. The analyzer comprises an equipotential space. On its way to the collector, the pulse is decomposed into several sub-pulses of the charged-particle current. Each such sub-pulse consists of charged particles with the same e/m ratios. The aforementioned decomposition occurs because in the initial pulse all charged particles have equal energies, while the speed of flight V and, hence, the time of flight t through the analyzer with the length equal to I are inversely proportional to $m^{1/2}$.

$$T=L(m/2\ \mathrm{eV})^{1/2}.$$

A series of pulses with different e/m ratios forms a mass spectrum that can be registered, e.g., with the use of an oscilloscope. Resolution capacity of such an instrument is proportional to length L.

An alternative version of the time-of-flight mass spectrometer is a so-called mass-reflectron, which allows an increase in resolution capacity due to the use of an electrostatic mirror. Energies of charged particles collected in each packet are spread over the temperature of the initial gas. This leads to broadening of peaks on the collector. Such broadening is compensated by the electrostatic mirror that prolongs the time of flight for slow charged particles and shortens the time of flight for fast charged particles. With the drift path being the same, the resolution capacity of a mass reflectron is several times the resolution capacity of a conventional time-of-flight mass spectrometer.

In the charged particle source of an RF mass spectrometer, charged particles acquire energy eV and pass through a system of several stages arranged in series. Each stage consists of three spaced parallel grids. An RF voltage is applied to the intermediate grid. With the frequency of the applied RF field and energies eV being constant, only those charged particles can pass through the space between the first and intermediate grids that have a predetermined M/Z ratio. The remaining charged particles are either retarded or acquire only insignificant energies and are repelled from the collection by means of a special decelerating electrode. Thus, only charged particles with the selected M/Z ratio reach the collector. Therefore, in order to reset the mass spectrometer for registration of charged particles with a different mass, it is necessary either to change the initial energy of a flow of charged particles, or frequency of the RF field.

Magnetic resonance mass analyzers operate on a principle that the time required for ions to fly over a circular trajectory will depend on the ion mass. In such mass analyzers, resolution capacity reaches $2.5\times10^4$.

The last group relates to ion-cyclotron resonance mass spectrometers in which electromagnetic energy is consumed by charged particles, when cyclotron frequency of the charged particles coincides with the frequency of the alternating magnetic field in the analyzer. The charged particles move in a homogeneous magnetic field B along a spiral path with so-called cyclotron frequency $\omega_c$=eB/mc, where c is velocity of light. At the end of their trajectory, the charged particles enter the collector. Only those charged particles reach the collector, the cyclotron frequency of which coincides with that of the alternating electric field in the analyzer. It is understood that selection of charged particles is carried out by changing the value of the magnetic field or of the frequency of the electromagnetic field. Ion-cyclotron resonance mass spectrometers ensure the highest resolution capacity. However, mass spectrometers of this type require the use of very high magnetic fields of high homogeneity, e.g., of 10 Tesla or higher. In other words, the system requires the use of super-conductive magnets, which are expensive in cost and large in size.

In a quadrupole mass spectrometer, charged particles are spatially redistributed in a transverse electric field with a hyperbolic distribution of the electric potential. This field is generated by a quadrupole capacitor having a D.C. voltage and RF voltage applied between pairs of rods. The flow of charged particles is introduced into a vacuum chamber of the analyzer in the axial direction of the capacitor via an input opening. With the frequency and amplitude of the RF field being the same, only charged particles with a predetermined M/Z ratio will have the amplitude of oscillations in the transverse direction of the analyzer shorter than the distances between the rods. Under the effect of its initial velocity, such charged particles will pass through the analyzer and will be registered and reach the collector, while all other charged particles will be neutralized on the rods and pumped out from the analyzer. Reset of such mass spectrometer to charged particles of another mass will require to change ether the amplitude or the frequency of the RF voltage. Quadrupole mass spectrometers have resolution capacity equal to or higher than $10^3$.

Attempts have been made to improve existing mass spectrometers of the time-of-flight type, e.g., by improving charged-particle storage devices, introducing deflectors for selection of charged-particle for analysis in a mass spectrometer, reorganizing sequencing of charged-particle packets or by extending the time of flight for improving resolution capacity of the mass spectrometers.

For example, U.S. Pat. No. 5,396,065 issued in 1995 to C. Myerholtz, et al. discloses an encoded sequence of charged-particles in packets for use in time-of-flight mass spectrometers, in which the high-mass charged particles of a leading packet will be passed by the low-mass charged particles of a trailing packet. Thus, a high efficiency time-of-flight mass spectrometer is formed. The charged particles of each packet are acted upon to bunch the charged particles of the packet, thereby compensating for initial space and/or velocity distributions of charged particles in the launching of the packet. The times of arrival of the charged particles are determined at the detector to obtain a signal of overlapping spectra corresponding to the overlapping launched packets. A correlation between the overlapping spectra and the encoded launch sequence is employed to derive a single non-overlapped spectrum.

However, such method and apparatus make interpretation of obtained data more complicated and not easily comprehensible. Furthermore, addition electronic circuits are required for control of the charged particle packet sequence.

U.S. Pat. No. 5,753,909 issued in 1998 to M. Park et al. describes a method and apparatus for analyzing charged particles by determining times of flight including using a collision cell to activate charged particles toward fragmentation and a deflector to direct charged particles away from their otherwise intended or parallel course. A disadvantage of this device consists in that it is based on the selection of specific charged particles and does not show the entire mass spectrum. For obtaining the entire spectrum, it is necessary to perform step by step scanning, and this requires an additional time.

A disadvantage of the device disclosed in U.S. Pat. No. 5,753,909 consists in that this mass spectrometer is based on the selection of specific charged particles and does not show the entire mass spectrum. For obtaining the entire spectrum, it is necessary to perform step by step scanning, and this requires an additional time.

U.S. Pat. No. 6107,625 issued in 2000 to M. Park discloses a coaxial multiple reflection time-of-flight mass spectrometer of a time-of-flight type with resolution capacity improved due to a longer time of flight of the charged particles. The apparatus comprises two or more electrostatic reflectors positioned coaxially with respect to one another such that charged particles generated by a charged-particle source can be reflected back and forth between them. The first reflecting device is a charged-particle accelerator which functions as both an accelerating device to provide the initial acceleration to the charged particles and a reflecting device to reflect the charged particles in the subsequent mass analysis. The second reflecting device is a reflectron, which functions only to reflect the charged particles in the mass analysis. During the mass analysis, the charged particles are reflected back and forth between the accelerator and reflectron multiple times. Then, at the end of the charged-particle analysis, either of the reflecting devices, preferably the charged-particle accelerator, is rapidly de-energized to allow the charged particles to pass through that reflecting device and into a detector. By reflecting the charged particles back and forth between the accelerator and reflectron several times, a much longer flight path can be achieved in a given size spectrometer than could otherwise be achieved using the time-of-flight mass spectrometers disclosed in the prior art. Consequently, the mass resolving power of the time-of-flight mass spectrometer is substantially increased.

This is a typical system with storage of charged particles, which does not allow a continuous mode of mass analysis since it requires some period for de-energization of one of the reflecting devices. Obviously, the data is difficult to interpret, especially when masses of charged particles are scattered in a wide range so that light charged particles may undergo several reflections while heavy charged particles made only one or two reflections.

The most advanced time-of-flight mass spectrometer (TOF MS) that provides extended time of flight trajectory and hence the time resolution is a quadrupole mass spectrometer developed by Y. Glukhoy and described in aforementioned U.S. patent application Ser. No. 10/058,153. This is the first mass spectrometer known in the art that provides helicoidal trajectories of charged particles by using only electrostatic lens optics.

A mass spectrometer of the aforementioned patent application is based on the use of quadrupole lenses with an angular gradient of the electrostatic field from lens to lens. The device consists of a charged-particle source connected to a charged-particle mass separation chamber that contains a plurality of sequentially arranged electrostatic quadrupole lenses which generate a helical electrostatic field for sending charged particles along helical trajectories in direct and return paths. Scattering of positions of points of return is reduced by means of electrostatic mirrors located at the end of the direct path, while charged particles of different masses perform their return paths along helical trajectories different from those of the direct paths due to the use of a magnetic and/or electrostatic mirrors.

A particle-electron emitting screen is installed on the path of charged particles in the return path, and positions of collision of the charged particles with the particle-electron emitting screen over time and space are detected with the use of micro-channel plate detectors. Movement of charged particles along the helical trajectory significantly increases the path of charged particles through the charged-particle separation chamber and, hence, improves the resolution capacity of the mass spectrometer.

However, the above-described helical-path quadrupole mass spectrometer, as well as all aforementioned known mass spectrometers of other types, is not very convenient for aerosol applications. This is because in some applications the aerosol analysis should be carried out with sampling and inputting of the aerosol substance into the mass-analyzing unit in a continuous mode. At the same time, all aforementioned apparatuses have a low-duty cycle and are characterized by a limited particle input, i.e., they have a single injection port for inputting particles to be analyzed into the mass spectrometer.

It should be noted that the use of mass spectrometers has come under scrutiny in recent years as a possible solution for a high-speed detection of the aerosol particles in the panorama mode. It can be used for early detection and real-time analysis of aerosol particles in the situation of the large area contamination after the chemical and biological attack or accident, or for general-purpose field, e.g., for monitoring of ozone-consuming organic materials, or the like.

However, the sensitivity of conventional TOF MS is affected by the aforementioned low-duty cycle, meaning only small fraction of charged particles originally in the continuous flow of charged particles is converted into the charged-particle packets and participates in the registration by the charged-particle detectors. Most of the charged particles are discarded from registration during "pulse and wait" time.

It should be recalled that an aerosol TOF MS is supposed to combine several processes which are the following: collection and preparation of samples to a form acceptable for mass spectroscopy; electron impact ionization; bunching of charged particles upon application of an electrical pulse to the gating electrode (usually a charged grid) i.e., conversion of the continuous flow of charged particles into the charged-particle packets; collimation of the flow of charged particles by introducing these charge-particle packets into the charged-particle flight region; traveling of the charged particles in the long drift tube; detecting the charged particles impinging the multi-channel plates; and analyzing the obtained data.

In all known aerosol TOF MS's, a significant amount of sample material is wasted. Usually 98% of the sample is lost during passing through the nozzle, skimmer's collimation, electron impact ionization and the entrance aperture. These losses are unavoidable. But others can be reduced significantly. For example, traveling losses due to collisions with molecules of the residual gas can be reduced by improving the vacuum and reducing the length of the drift tube. This objective was achieved in aforementioned U.S. patent application Ser. No. 10/058,153 due to the use of an extended (direct-return) helical trajectory of the particles.

It should be noted, that analysis conducted in a conventional aerosol TOF MS requires that the continuous flow of particles be interrupted. Otherwise, it would be impossible to perform selection and tracing of individual particles for which the time-of-flight and, respectively, spectra of masses, have to be determined. However, in conventional aerosol TOF MS, bunching, i.e., in a process that extracts particles from a continuous charged-particle flow, is insufficient and therefore in some cases leads to the loss of very important information and hence to decrease in the sensitivity of the TOF-MS as whole. To increase the signal-to-noise ratio, such conventional systems use expensive amplifiers and logistical systems.

Conventionally, the stream of charged particles is divided into packets of ions that are launched along the propagation path using a traditional "pulse-and-wait" approach. The second packet can't be launched before all charged particles from the first packet reach the charged-particle detector in order to prevent overlapping of signals. Because each packet can contain only a few charged particles of the species of the materials, the experiment has to be repeated many times. So, it is impossible to reach in the condition of the flight the quality of the measurement that is sufficient to identify the aerosol compound using a conventional TOF MS. In other words, conventional TOF MS's have a limited low-duty cycle, and the authors are not aware of any known means that can increase the duty cycle above 60%.

For measurement of masses of particles, the data obtained in an aerosol TOF MS must be analyzed. Heretofore, different methods have been used for reconstruction of the particle distribution spectra in acquisition period of the cycle. Such methods are described e.g., by the following authors: 1) G. Wilhelmi, et al. in "Binary Sequences and Error Analysis for Pseudo-Statistical Neutron Modulators with Different Duty Cycles," Nuclear Inst. and Methods, 81 (1970), pp. 36–44; 2) Myerholtz, et al. "Sequencing ion packets for ion time-of-flight mass spectrometry" (see aforementioned U.S. Pat. No. 5,396,065 described earlier in the description of the prior art); 3) Cocg "High-duty cycle pseudo-noise modulated time-of-flight mass spectrometry" (U.S. Pat. No. 6,198,096, issued Mar. 6, 2001; 4) Brock, et al. "Time-of-flight mass spectrometer and ion analysis" (U.S. Pat. No. 6,300,626, issued Oct. 9, 2001); 5) Overney, et al. "Deconvolution method and apparatus for analyzing compounds" (U.S. Pat. No. 6,524,803, issued Feb. 25, 2003), etc.

The above methods utilize special properties of the pulsing sequence, e.g., a pseudo-random binary sequence (PRBS) or Hadamard Transform. However, they cannot reach a high-duty cycle because their TOF MS's annihilate a part of the flow of charged particles by a gating grid [see references 3) and 4)] or deflecting mesh [see reference 5)] during binary modulation that they converted. This is because at least a half of the charged-particle flow must be discarded to allow the other half to be counted. The flow of charged particles sputters and contaminates the modulation grids or meshes and creates secondary electron-, ion-, or photon-emission leading to deterioration of the grids. Furthermore, foreign species introduced in the drift space because of contamination and sputtering destruct the detectors and distort the information. The low sensitive flat deflection system, which is used in the in the A. Brock et al TOF-MS for the Hadamard's transform, contains a high density array of the wires with alternating potential that leads to breakdown.

So the conventional TOF-MS's with the pseudo-random binary methods of bunching of the ion packets can not provide high-duty cycle, have low sensitivity and reliability, and cannot serve properly as monitoring devices for field applications because of the incorrect choice and design of the ion optics and the irrational bunching strategy.

The disadvantages of the known aerosol TOF MS's make them unsuitable for aforementioned high-duty analysis under extreme or critical conditions such a biological attack or an environmental disaster, e.g., a hazardous leakage or contamination of water reservoirs in populated areas.

SUMMARY OF THE INVENTION

It is an object of the present invention to provide an aerosol time-of-flight mass (TOF MS) spectrometer suitable for continuous operation in a high-duty mode. Still another object is to provide an aerosol TOF MS that divides a single flow of particles at the TOF MS input into a plurality of independent flows that are analyzed without mutual interference. It is another object of the present invention to provide a mass spectrometer that combines in itself such features as a reasonable cost, high performance characteristics, simple construction, and high resolution capacity. Another object is to provide a method of mass analyses, which allows to improve sensitivity and resolution capacity of a mass spectrometer. Another object is to provide a mass spectrometer operating in real time with convenient presentation of data for analysis. Still another object is to provide a mass spectrometer that combines advantages of dynamic time-of-flight systems with those of static mass spectrometers.

An aerosol TOF MS of the present invention is based on the use of quadrupole lenses with angular gradient of the electrostatic field. On the entrance side, the TOF MS contains an ion-optic system that is used for focusing, aligning, and time-modulating the ionized flow of particles and a deflector modulator that provides alternating deflections of the flow of particles between two positions for aligning the flow with two inlet openings into the TOF MS. As a result, two independently analyzed discrete flows of particles pass through the ion mass separation chamber of the TOF MS without interference with each other. The ion mass separation chamber contains a plurality of sequentially arranged coaxial electrostatic quadrupole lenses which generate a helical electrostatic field for sending ions along helical trajectories in direct and return paths. Scattering of positions of points of return is reduced by means of electrostatic mirrors located at the end of the direct path. On their return paths, depending on their masses, the particles of the same ion beam current pulse will hit the respective micro-channel plate detector, located on the entrance side, in different points and at different times. The ions incident on the micro-channel plate detector knock out secondary electrons from the surface of the detector, and the moment of the collision will be registered as a pulse on the output of the respective micro-channel plate detector. The time of the collision and the magnitude of the pulse will contain information about the M/Z ratio for the particles being registered. Accurate detection of collision time is possible due to extremely high-resolution capacity of these devices. Multiplication of a single flow of particles into a plurality of independent and spatially separated flows propagating in one chamber increases efficiency of the TOF MS and makes it possible to use it in continuous and high-duty applications. Thus, the efficiency of the duty cycle can be as high as 98%, which is unattainable with any known device of this class.

DETAILED DESCRIPTION OF THE INVENTION

Figure 1:
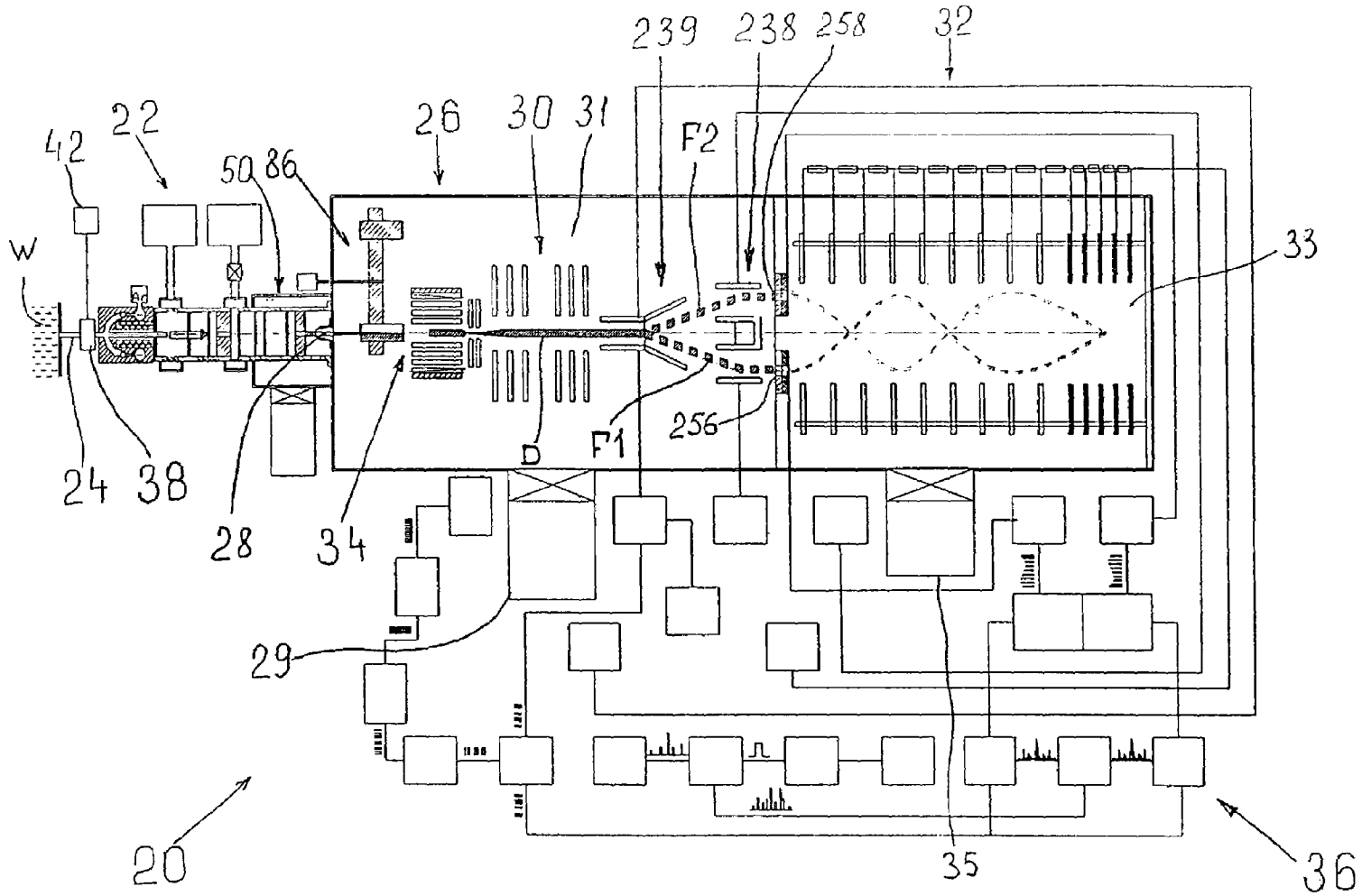
FIG. 1 is a schematic sectional view of the entire system that contains the aerosol TOF MS of the present invention.

A schematic view of an aerosol TOF MS of the present invention, which in general is designated by reference numeral 20, is shown in FIG. 1. The aerosol TOF MS 20 consists of the following main units arranged in sequence: 1) a sampling device 22 which produces trains of uniformly-sized and uniformly-spaced particles D of a liquid that may contain a sought substance and is taken through an interface 24, e.g., from sea water; 2) an ionization device 26 which is connected to an output 28 of the sampling device 22 for receiving the aforementioned train of the uniformly-sized and uniformly-spaced particles D which are ionized and focused during transportation through an ion-optic system 30; 3) an aerosol TOF MS unit 32 that receives on its input 34 the ionized and diverged train of particles D, focuses this train of particles, and distributes the particles over their mass/charge ratio; and 4) data acquisition and analysis unit 36 that acquires, accumulates the data from the aerosol TOF MS unit 32 in a real-time mode, and analyses concentration and changes in concentration of a target substance in the investigated medium. Now, each of the aforementioned main units will be shortly considered separately, except for the TOF MS 32 that will be considered in detail.

In the aerosol TOF MS of the invention, the principle of sampling is based on a device similar to the one disclosed in U.S. Pat. No. 5,345,079 issued in 1994 to J. French, et al. In accordance with the above patent, a liquid sample to be analyzed is fed to a micro pump. The pump directs the solution, as a stream of uniformly sized and spaced particles, into a laminar stream of hot carrier gas. The carrier gas evaporates the solvents (e.g. water W) in the particles to form a stream of dried particles. The stream of particles can be then vaporized. Similar to the sampling unit of our invention, the sampling unit of U.S. Pat. No. 5,345,079 is intended for sending the stream of uniformly sized and spaced particles to an ionizer and then to a mass spectrometer, or the vapor can be analyzed by optical spectroscopy.

Figure 2:
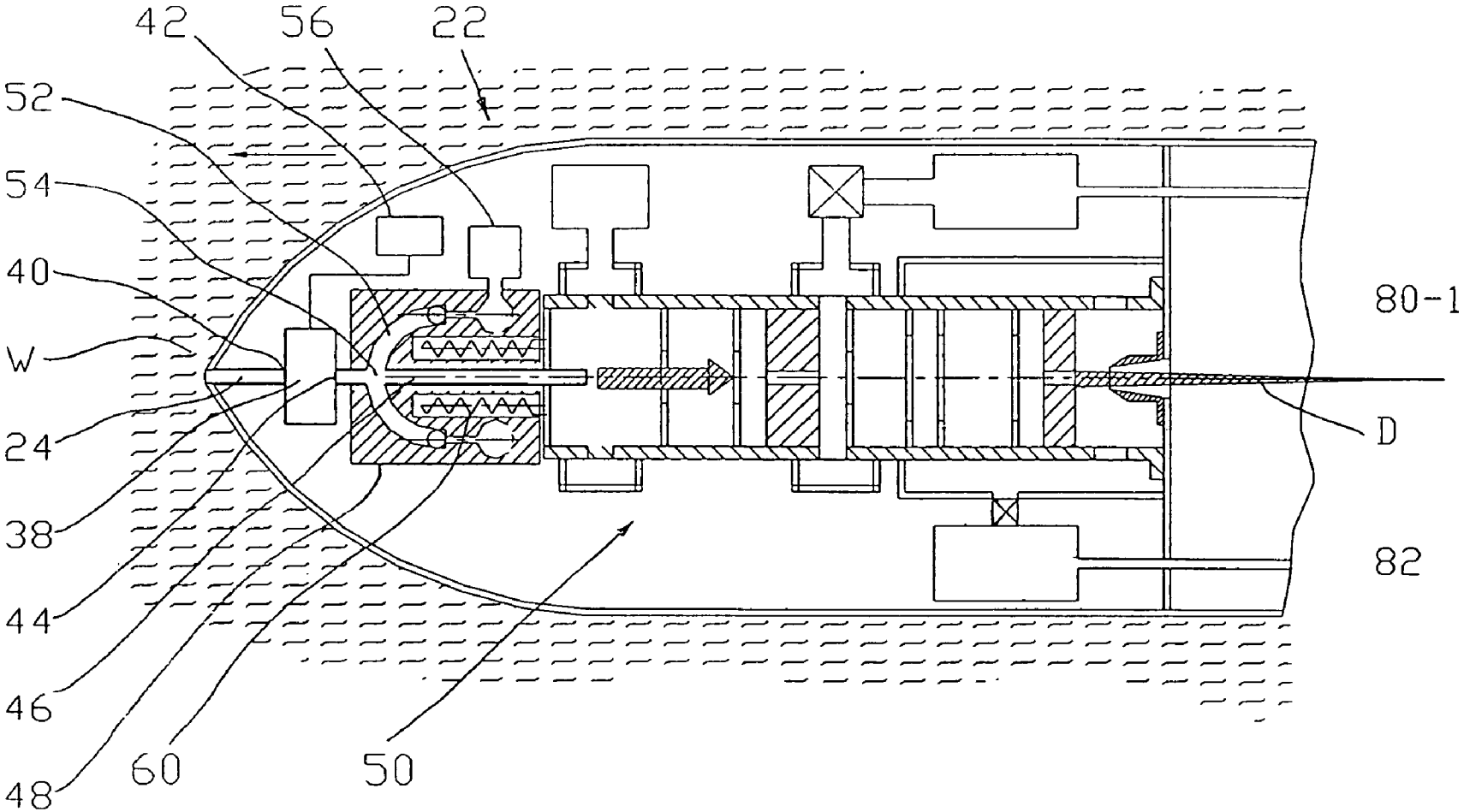
FIG. 2 is a sectional view of the sampling unit used in the TOF MS of FIG. 1 for sampling and preparing particles for input into the ionization device of the TOF MS of FIG. 1.

The sampling unit 22 suitable for use in conjunction with the aerosol TOF MS 32 of the present invention is shown in FIG. 2 and described in more detail in pending U.S. patent application Ser. No. 10/782,132 filed on Feb. 18, 2004 by the same applicant. This unit, that produces trains of uniformly-sized particles D, contains a micro pump 38, which is connected to a signal source 42 for supplying the pump 38 with an electrical signal required for controlling the particle repetition rate or frequency. The micro pump 38 has an outlet port 44 connected to narrow tube 46 for ejecting particles D.

The device is provided with an annular gas passage 52. The passage 52 joins a tube 46, and the place of joining, which in FIG. 2 is designated by reference numeral 54. A carrier gas such as argon is supplied from a gas source 56 into the passage 52.

The mixer block 48 is provided with heater rods 60 that maintain the block 48 heated to a substantial temperature. The heater rods 60 are located in the metal annulus of the block 48 between the passage 52 and the tube 46. The heater rods 60 heat the flow that passes through the tube 46 for evaporation of water from the particles D leaving a stream of dried micro particles that are injected together with argon through into the aforementioned aerodynamic lens system 50 as a supersonic flow.

The sampling unit of the type disclosed in U.S. Pat. No. 5,345,079, as well as practically all other known aerosol TOF MS's, introduces the flow of ionized particles directly to the vacuum chamber of a mass spectrometer without the use of any intermediate preparatory device. Normally, such devices have a very short service life. This is because the inlet orifices for the introduction of the flow of particles D to the TOF MS are quickly contaminated and clogged, so that the process has to be stopped and the orifice has to be cleaned or replaced. This drawback makes the aforementioned combination unacceptable for operation in a continuous mode for which the apparatus 20 (FIG. 1) of the present invention is intended.

In the TOF MS 32 of the present invention, the above problem is solved by means of a rotary nozzle replacement system 86 located in a vacuum chamber 31 of the apparatus 20 (FIG. 1) on the front end of the ionization device 26. Reduced pressure in the vacuum chamber 31 is provided by a vacuum pump 29. The rotary nozzle replacement system 86 is described in more detail in aforementioned pending U.S. patent application Ser. No. 10/782,132.

The aerosol TOF MS of the present invention (FIG. 1) is provided with an aerodynamic lens system 50 located between the ionizer 22 and the mass spectrum unit 32. The aerodynamic lens system 50 is intended for improving control of particle sizing and for scanning the particle size.

More specifically, the aerodynamic lens system 50 (FIG. 2) consists of a two vacuum stages and a number of aerodynamic lenses in each stage. Each aerodynamic lens comprises an annular body with an opening of a predetermined diameter with gradual decrease in the diameter of the lens in propagation direction of the stream.

Figure 3:
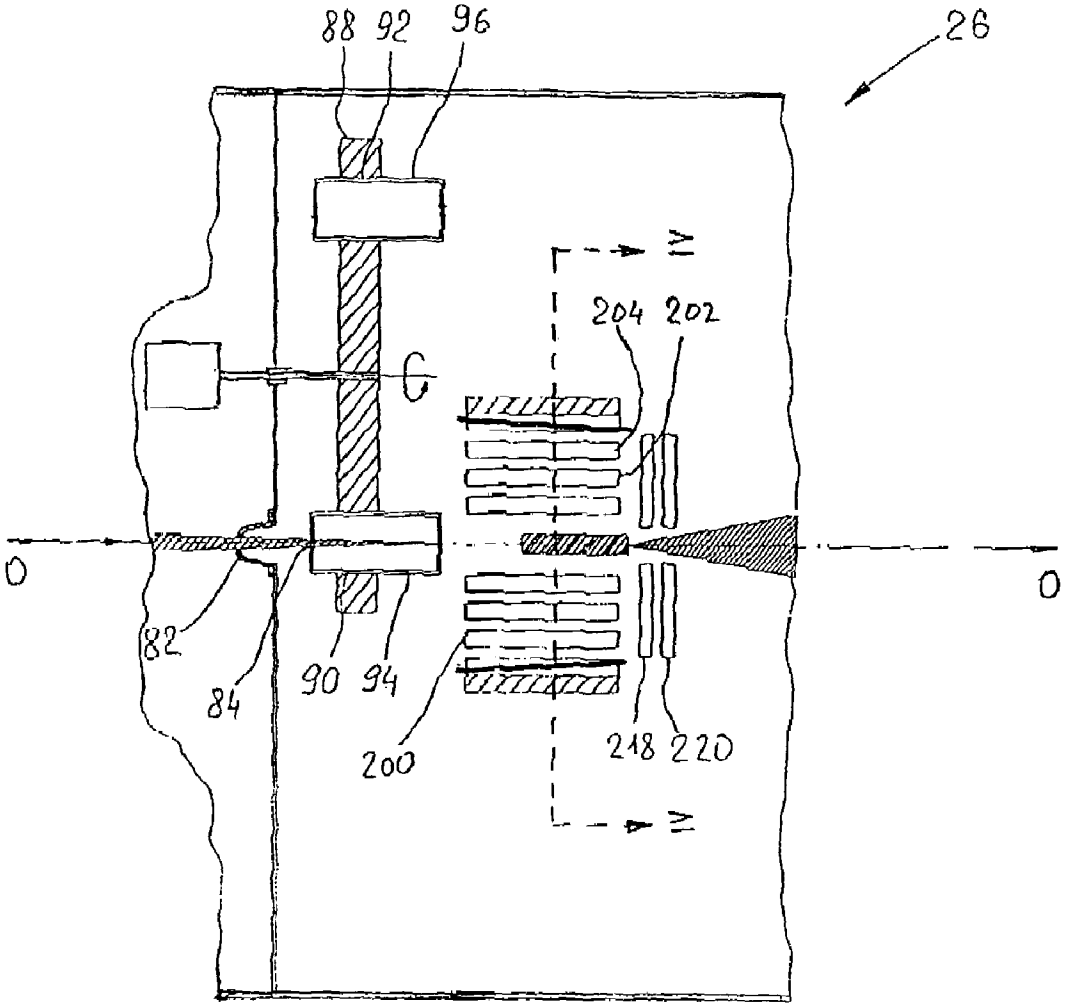
FIG. 3 is a longitudinal sectional view that illustrates arrangement of units in the ionization device of the TOF MS of the present invention.
Figure 4:
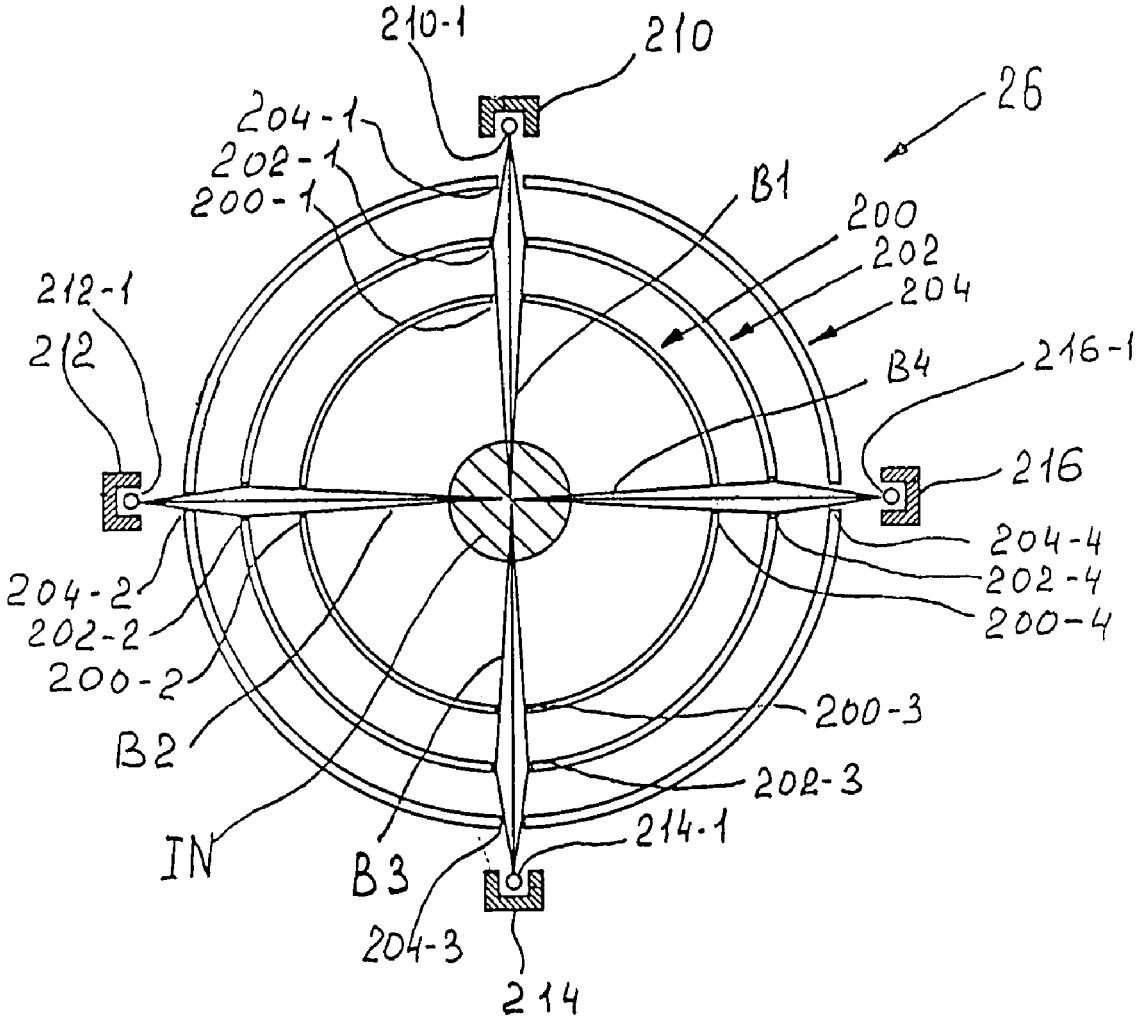
FIG. 4 is a cross-sectional view of the ionization device along the line IIIB—IIIB of FIG. 3.

The aerodynamic lenses accomplish the task of particle beam formation,

The ionization device 26 is shown in FIGS. 3, 3B and 4, wherein FIG. 3 is a longitudinal sectional view that illustrates arrangement of units in the device 26, FIG. 4 is a cross-sectional view along the line IIIB—IIIB of FIG. 3. The device contains the aforementioned rotary nozzle replacement system 86 located in a vacuum chamber 31 of the apparatus 20 (FIG. 1) on the front end of the ionization device 26. Reduced pressure in the vacuum chamber 31 is provided by a vacuum pump 29. The ionization device suitable for use in conjunction with the aerosol TOF MS 32 of the present invention is described in more detail in aforementioned pending U.S. patent application Ser. No. 10/782,132.

The next unit of the ionization device 26 arranged in the direction of the particle flow after the rotary nozzle replacement system 86 comprises the ionizer per se that consists of three coaxial cylindrical bodies (FIGS. 3 and 4), i.e., a central cylindrical body 200, an intermediate cylindrical body 202, and an external cylindrical body 204. As shown in FIG. 4, all cylindrical bodies have four aligned longitudinal slits on their outer surfaces, which extend in the directions parallel to the central axis of the cylindrical bodies. More specifically, the central cylindrical body 200 has slits 200-1, 200-2, 200-3, and 200-4; the intermediate cylindrical body has slits 202-1, 202-2, 202-3, and 202-4; and the external cylindrical body 204 has slits 204-1, 204-2, 204-3, and 204-4. Thus, the silts divide each cylindrical body into four concave segments with the concave sides facing the central axis O—O (FIG. 3).

Reference numerals 210, 212, 214, and 216 designate elongated electron guns with respective filaments 210-1, 212-1, 214-1, and 216-1. Electron beams B1, B2, B3, and B4 generated by the electron guns 210, 212, 214, and 216 and formed by the concave segments of the electron optics are directed into the flow of particles D (FIG. 1) ionize the particles D in the ionization zone IN.

The aforementioned ionization device 26 itself constitutes a subject of the aforementioned pending U.S. patent application Ser. No. 10/058,153 and therefore herein further description of the ionization device 26 is omitted.

It should be noted, however, that the aforementioned orifice 94 of the rotary nozzle replacement system 86 (FIG. 3) serves as an entrance diaphragm of the ionization device 26, while the set of two diaphragms 218-1 and 218-2 is used as an outlet of the ionization device 26. These entrance and outlet diaphragms are maintained under a potential of a negative volume charge in order to prevent penetration of the external electrical fields into the ionizer and thus to prevent extraction of slow electrons from the space charge. This is important since such electrons compensate for the aforementioned space charge of positive particles. The diaphragms 218-1 and 218-2 are electrically interconnected and connected to the negative terminal of a DC power supply (not shown).

Thus, the ionization device transforms the flow of substantially neutral particles D that enter this device into a slightly diverged flow of ionized particles D. For matching with the entrance of the aerosol TOF MS unit 32, the flow of ionized particles D should be focused, aligned, and time-modulated, with the TOF MS entrance.

All devices of the aerosol TOF MS unit 32 are located in a high-vacuum chamber 33 of the unit 32, which is evacuated with the use of a vacuum pump 35.

Thus, the ionization device 26 transforms the flow of substantially neutral particles D that enters this device into a slightly diverged flow of ionized particles D that are emitted from the outlet of the ionization device to the entrance of the aerosol TOF MS unit 32. This flow of ionized particles D should be focused, aligned, and time-modulated, with the TOF MS entrance.

The functions of focusing, aligning, and time-modulating the ionized flow of particles with the aerosol TOF MS unit 32 are accomplished by means of an ion-optic system 30 and a deflector modulator 239 with a steering deflector 238 (FIG. 1) which provides alternating deflections of the flow of particles between two positions F1 and F2 for aligning the flow with two inlet openings 256 and 258 into the TOF MS 32. These units will now be considered in more detail.

Figure 5:
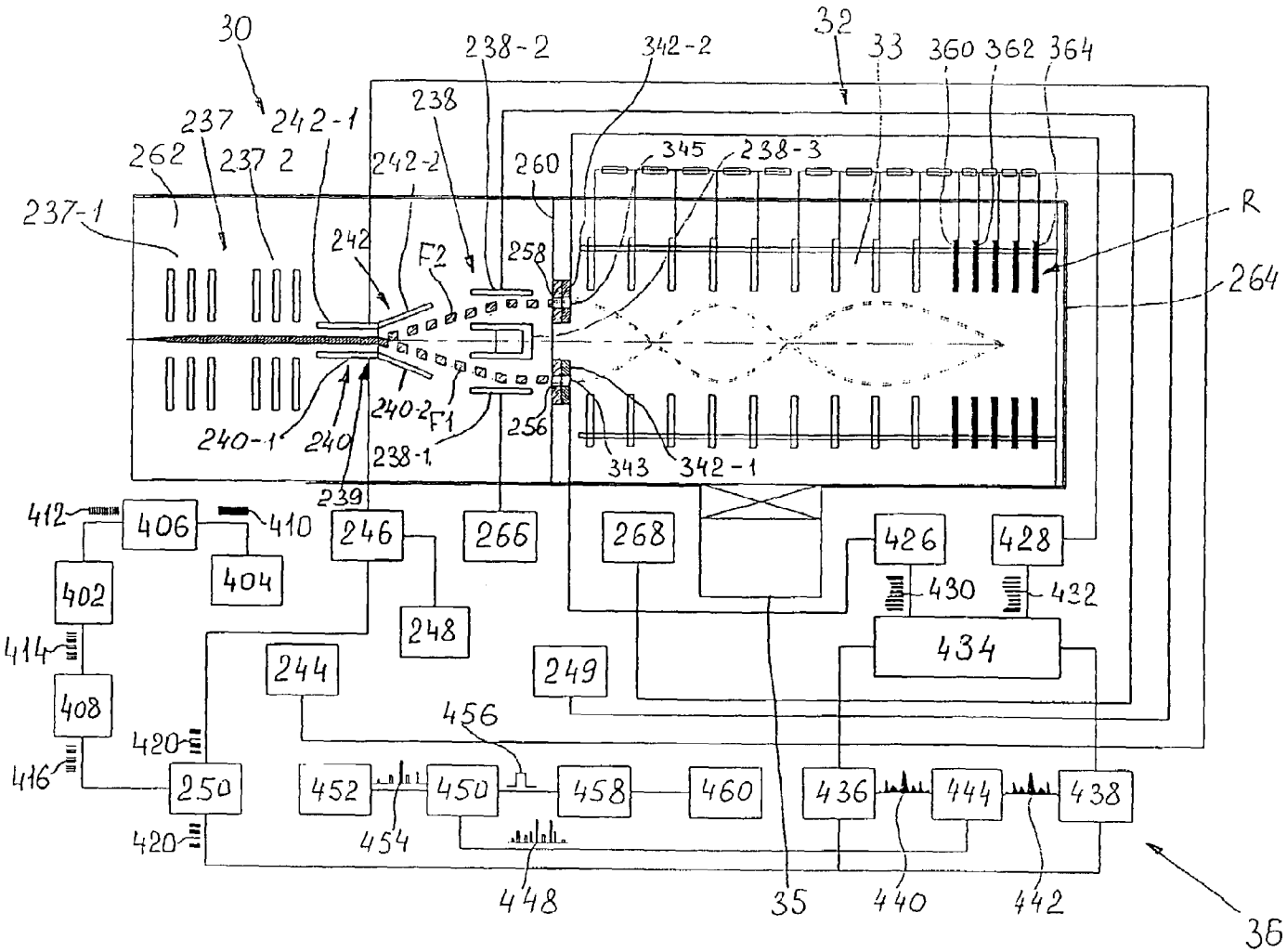
FIG. 5 is a schematic sectional view that illustrates the ion mass separation chamber with the ion-optic system and deflector modulator on the entrance side of the TOF MS of FIG. 1.

The functions of focusing, aligning, and time-modulating the ionized flow of particles with the aerosol TOF MS unit 32 are accomplished by means of focusing lenses 237, and a deflector modulator 239 (FIG. 1 and FIG. 5). FIG. 5 is a schematic longitudinal sectional view of the apparatus 20 of the invention that illustrates the arrangement of the focusing lenses 237, the deflector-modulator 239, and of the TOF MS unit 32 in connection with the ionization device 26 and the data acquisition and analysis unit 36.

This focusing lenses 237 comprises two set 237-1 and 237-2 of diaphragms, three in each set, that transform the ionized flow of particles D with slight divergence into a parallel flow and direct this flow into the entrance of the deflector-modulator 239. In the embodiment illustrated in FIGS. 1 and 5, the continuous parallel flow of ionized particles D is alternately deflected by the aforementioned deflector-modulator 239 that consists of two plates 240 and 242. Portions 240-1 and 242-1 of the of the plates 240 and 242, which are located at the input side of the deflector-modulator 239, are parallel to each other, while portions 240-2 and 242-2 of the plates located at the output side of the deflector-modulator 239, diverge towards the TOF MS 32. One plate of the deflector-modulator 239, e.g., the plate 242, is connected to a DC power supply 244 that provides the deflection of the ion beam with angle $\alpha$. The opposite plate 240 is connected through a switcher 246 to a DC power supply 248 that provides deflection of the ionized flow of particles D with angle 2α. but in the opposite direction.

This switcher 246 is connected to the random pulse modulation system 250 that generates the irregular sequence of switching pulses to split by the deflector unit 239 the continuous flow of ionized particles D into two discontinuous flows F1 and F2 (FIG. 5). Each part of ion flow is directed by the deflector-modulator 239 to a respective steering deflector 238-1 and 238-2 with a mutual grounded electrode 238-3 that is designed as a rectangular box with a blind hole in the middle.

The steering deflectors 238-1 and 238-2 have a permanent potential to correct trajectories of the component flows F1 and F2 and direct them in apertures 252 and 254 of diaphragms 256 and 258 in a barrier 260 between an MS vacuum chamber 262 and a TOF-MS drift tube 264. The DC voltages on the steering deflectors 238-1 and 238-2 relative to the common electrode 238-3 are applied from adjustable DC power supplies 266 and 268, respectively (FIG. 5).

Thus, the deflector-modulator 239 forms two separate flows F1 and F2 of ionized particles by chopping a single flow of ionized particles that arrives from the ionization device 26. Division of a continuous flow of particles into several separate flows for different inputs to the TOF MS unit is an unique feature of the apparatus of the invention, since it allows simultaneous flights of particles along two non-interfering trajectories with individual spatial distribution of particles and with independent data processing of this data in independent channels. Division of the continuous flow only into two separate flows F1 and F2 was shown only for the sake of simplicity of explanation and drawings. It is understood that the single flow can be divided into more than two separate flows, if particles of each flow can be unequivocally identified.

One of the most important parts of the aerosol TOF MS 32 is an electrostatic spiral quadrupole ion optics unit 270, which hereinafter will be referred to as a spiral quadrupole optics. Although with some differences, this unit is described in U.S. patent application Ser. No. 058153 filed by one of the applicant of the present application in 2002. Since the spiral quadrupole optics 270 plays an important role in the aerosol TOF MS 32, this unit will now be describe in detail.

Figure 6:
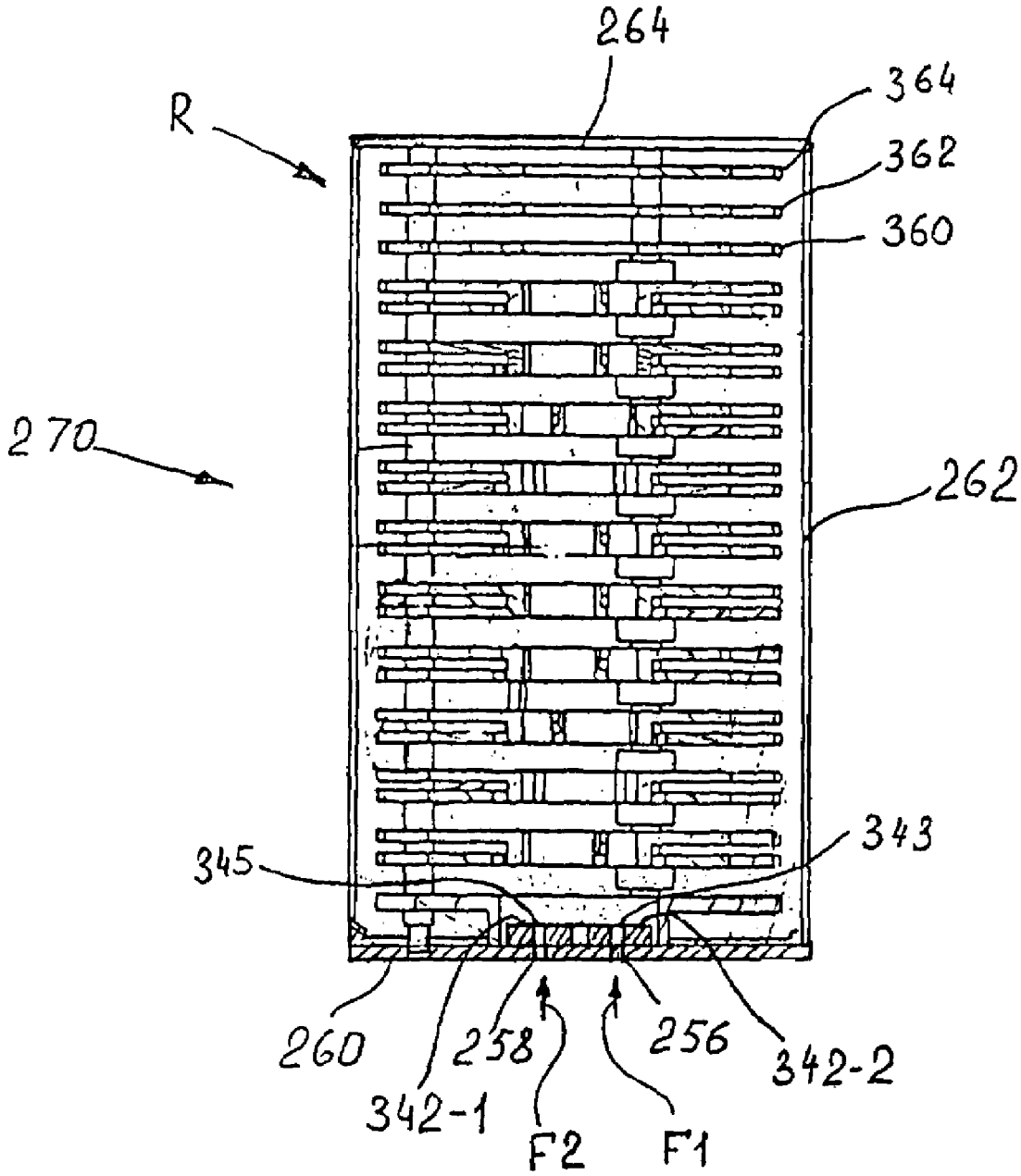
FIG. 6 is a longitudinal sectional view of the ion mass separation chamber of the aerosol TOF MS of the present invention.

The aerosol TOF MS 32 with the spiral quadrupole optics 270 is shown in FIG. 6, which is a longitudinal sectional view of this unit. The aerosol TOF MS 32 has a sealed housing 322 (FIG. 6), in which in the direction of propagation of the particles the spiral quadrupole optics 270 is located after the set of the focusing lenses 237, deflector-modulator 239, steering deflectors (238-1, 238-2, 238-3), and diaphragms 256 and 258 (FIG. 5). Furthermore, in contrast to aforementioned previous patent application Ser. No. 10/058,153, the TOF MS 32 does not have a separate electron-emission screen and separate micro-channel plates. In the device of the invention, functions of both these units are accomplished by micro-channel plate detectors 342-1 and 342-2. Although only two such detectors are shown and described with reference to FIGS. 5 and 6, a plurality of such detectors can be used, one for each injector. Since the micro-channel plate detectors 342-1 and 342-2 are applied onto the diaphragms 256 and 258, in order to provide unobstructed passage of the particle flows F1 and F2, the micro-channel plate detectors 342-1 and 342-2 have openings 343 and 345, which are aligned with respective diaphragms 256 and 258. Thus, the input injectors of the spiral quadrupole optics 270 are formed by the diaphragms 256, 258 and openings 343, 345. The surface of the micro-channel plate detectors, except for the openings, works as a single-stage detector for ions and charged particles.

Figure 7:
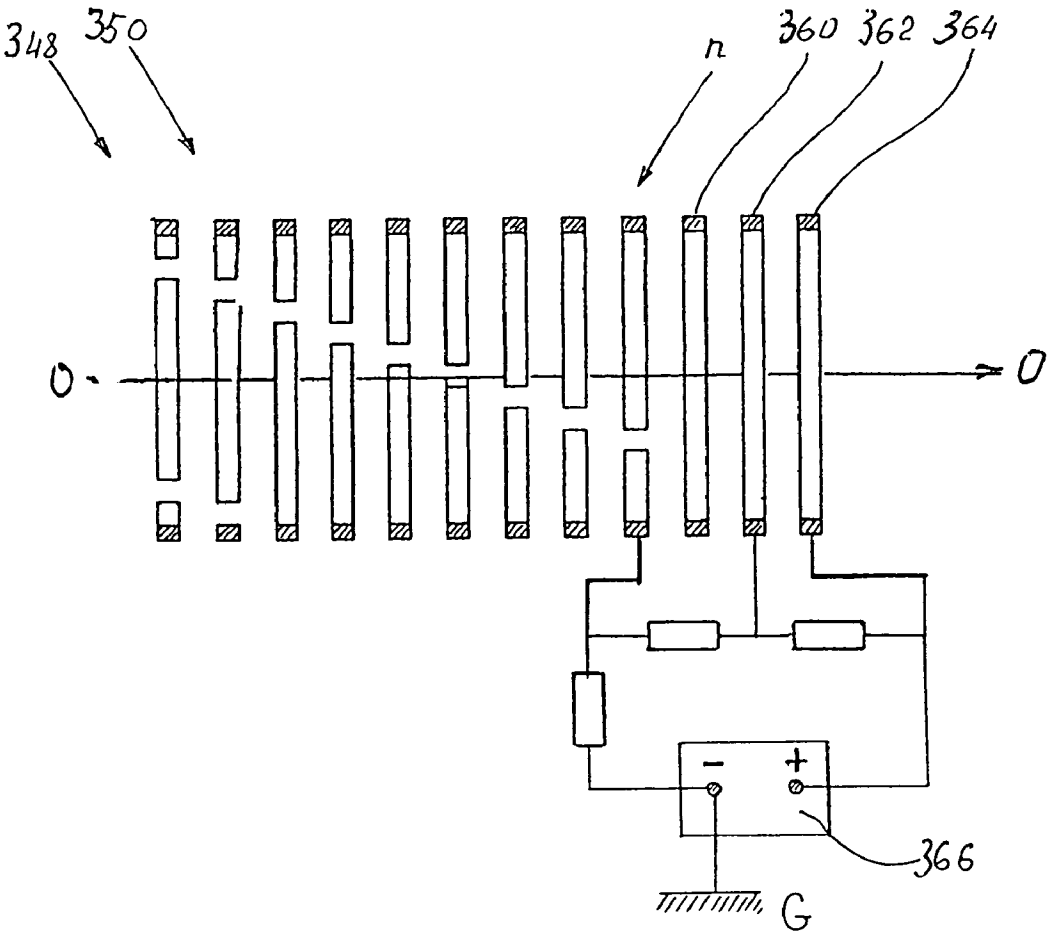
FIG. 7 is an axial sectional view of the electrostatic lens assembly.
Figure 8:
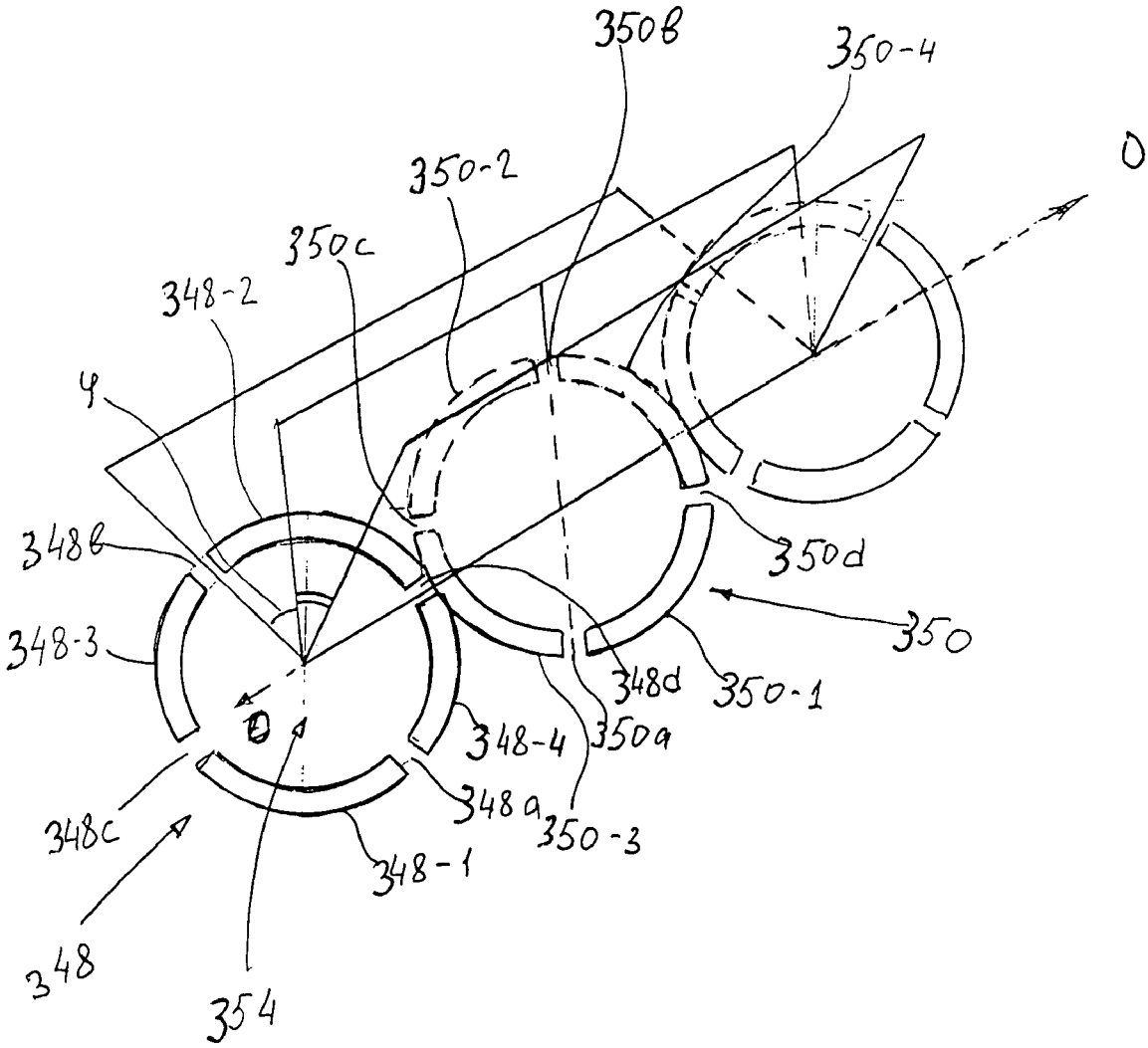
FIG. 8 is a three-dimensional view of three sequential quadrupole lenses illustrating angular shift of the poles.

The spiral quadrupole optics 270 contains a series of sequentially arranged quadrupole electrostatic lenses 348, 350 . . . FIG. 7 is an axial sectional view of the electrostatic lens assembly composed of the aforementioned lenses 348, 350, . . . , and FIG. 8 is a three-dimensional view of three sequential quadrupole lenses illustrating angular shift of the poles. The assembly shown in FIG. 7 consists of nine lenses, which are shown in this quantity only as an example. As can be seen from FIGS. 7 and 8, each lens consists of four equally spaced arch-shaped poles. More specifically, the quadrupole lens 348 consists of poles 348-1, 348-2, 348-3, and 348-4, the quadrupole lens 350 consists of four equally-spaced arch-shaped poles 350-1, 350-2, 350-3, and 350-4, the quadrupole lens 352 consists of four equally-spaced arch-shaped poles 352-1, 352-2, 352-3, and 352-4, etc. (other lenses are nor shown). Each lens has a central opening, so that in combination these openings form a central ion-guiding channel 354. In each circular quadrupole lens, the poles are separated in the circumferential direction by gaps, i.e., by gaps 348*a*, 348*b*, 348*c*, and 348*d* in the quadrupole lens 348, by gaps 350*a*, 350*b*, 350*c*, and 350*d* in the quadrupole lens 350, etc.

As can be seen from FIGS. 7 and 8, the quadrupole lenses of the assembly are shifted angularly with respect to each other to an angle equal to 360° divided by the number of the circular lenses in the assembly. In the embodiment of the spiral quadrupole optics 270 shown in FIGS. 6–8, the angular shift of the poles and gaps of each sequential circular quadrupole lens with respect to the preceding lens is equal to 360°/9=40°. It is understood that these numbers are given only as an example and that the number of circular quadrupole lenses and hence the angular shift could be different.

The purpose of the aforementioned angular shift between the poles of the sequential quadrupole lenses 348, 350, . . . is to create specific electrostatic quadrupole fields in axial spaces between the planes of the adjacent lenses. These gradient fields are arranged along the ion-guiding channel 354 in the direction of propagation of ions emitted from the ionization device 26 (FIG. 1), i.e., along the longitudinal axis O—O (FIGS. 7 and 8). The aforementioned electrostatic quadrupole fields are characterized by an angular gradient with the angle measured in planes perpendicular to the axis O—O or parallel to the planes of the lenses. In combination, the aforementioned specific electrostatic quadrupole fields can be considered as a single helical electrostatic quadrupole field.

Figure 9:
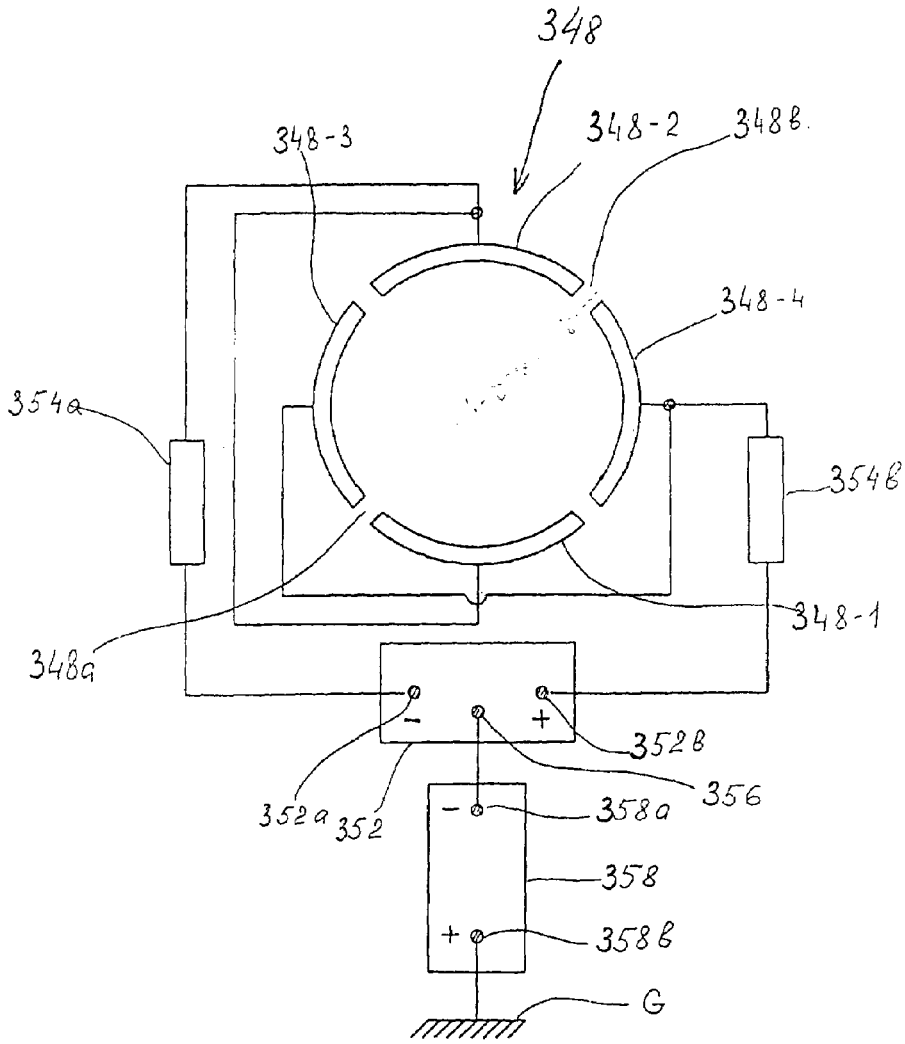
FIG. 9 is an electric circuit illustrating application of electric potentials to the poles of one of the circular electrostatic quadrupole lenses of the assembly shown in FIG. 7.

The aforementioned helical electrostatic quadrupole field can be realized with an application of respective electric potentials to the poles of the sequential circular quadrupole lenses. FIG. 9 shows an electric circuit illustrating application of electric potentials to the poles of one of the circular electrostatic quadrupole lenses, e.g., the lens 348. As can be seen from FIG. 9, the lens 348, as well as any other lens of the assembly, consists of two pairs of diametrically opposite poles receiving equal potential. Thus, in FIG. 9, the first pair consists of the poles 348-1 and 348-2 connected to a negative terminal 352*a*, while the second pair consists of the poles 348-3 and 348-4 connected to a positive terminal 352*b* of a power source 352. Each pair the poles is connected to the respective terminal via an electric resistor, i.e., a resistor 354*a* for the poles 348-1 and 348-2, and a resistor 354*b* for the poles 348-3 and 348-4. In the example shown in FIG. 9, the power source 352 has −20V on its negative terminal 352*a* and +20V on the positive terminal 352*b*. The midpoint 356 of the power source 352 is connected to a negative terminal 358*a* of a high-voltage power source 358, the positive terminal 358*b* of which is grounded at G. In the embodiment shown in FIG. 9, the terminal 358*a* of the high-voltage power source 358 has a potential of −4.5 kV.

Each successive circular quadrupole lens of the lens assembly has the potential application circuit the same as the one shown in FIG. 9, with the exception that the poles are angularly shifted by angle equal to 360° divided by the number of the circular lenses in the assembly. In the embodiment of the invention shown in FIGS. 6–9 with nine lenses, the shift angle will be equal to 40°. Another distinction of the circuits in the sequential lenses is that the potential on the negative terminals (that correspond to the terminal 358*a* of the source 358 in FIGS. 8 and 9, will be reduced in each lens by 500V in the direction of propagation of the ions. Thus, if the first lens 348 has on the terminal 358*a* of the high-voltage source 358 a negative potential of −4.5 kV, then in the second lens 350 a respective terminal will have a potential equal to −4 kV, etc. More specifically, the central point (such as point $\mathbf{348}_0$ of the lens 348 shown in FIG. 9 ) will have a potential equal to −4.5 kV in the lens 348, −4 kV in the lens 350, −3.5 kV in the next lens, and finally, the last lens will have a potential equal to 0.

Figure 10:
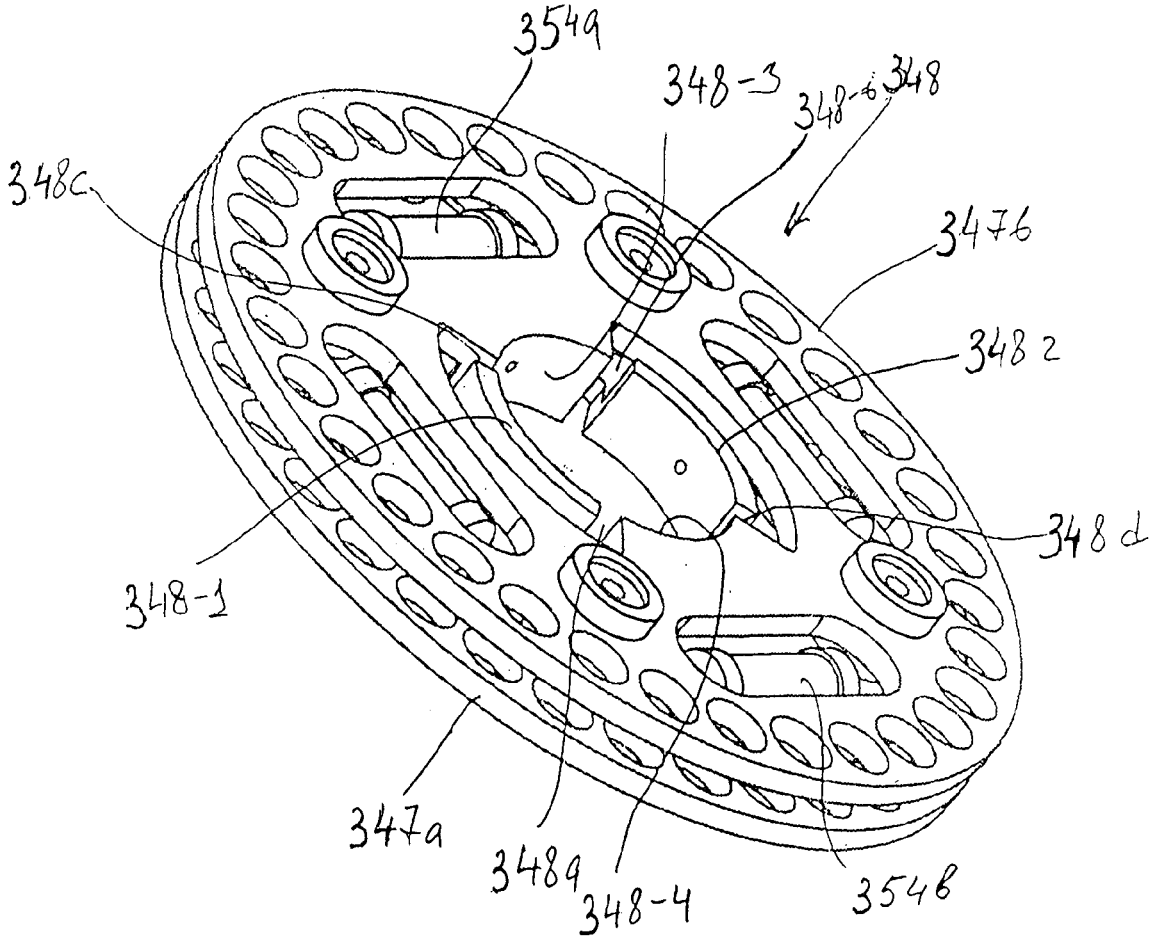
FIG. 10 is a three-dimensional view illustrating a construction of one of the electrostatic quadrupole lenses.
Figure 11:
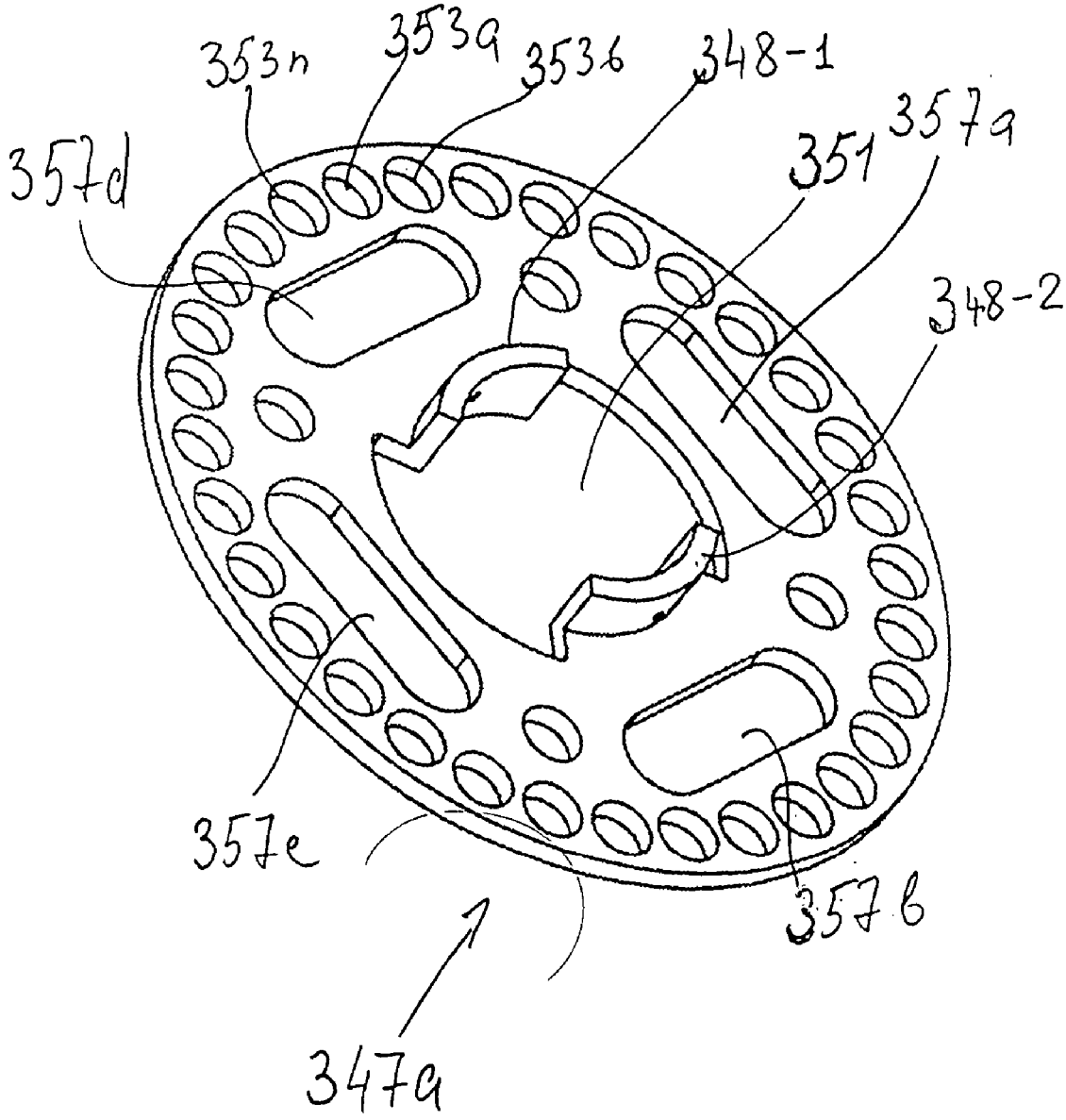
FIG. 11 is a three-dimensional view of one of component disks from which the lens is assembled.

FIG. 10 is a three-dimensional view illustrating the construction of one of the electrostatic quadrupole lenses, e.g., the lens 348. FIG. 11 is a three-dimensional view of one of standard component disks from which the lens 348, as well as all other lenses of this unit, is assembled. More specifically, it is advantageous to assemble each electrostatic quadrupole lens from two identical disks 347*a* and 347*b* (only one of these disks, i.e., the disk 347*a* is shown in FIG. 10). The disk 347*a* has a central opening 351 with two diametrically opposite arch-shaped axial projections that will be used as poles 348-1 and 348-2. Openings 353, 353*b*, . . . 353*n* are needed for assembling and of the electrostatic quadrupole lenses within the spiral quadrupole optics 270 by means of dielectric, e.g., ceramic, rods (only one of these rods 355 is shown in FIG. 6 in order to simplify the drawing). Oval windows 357*a*, 357*b*, 357*c*, and 357*d* are used for accommodation of resistors 354*a*, 354*b* (FIG. 9). As shown in FIG. 10, the lens 348 is easily formed by imposing the disk 347*a* onto the disk 347*b* in mirror positions of both disks and with angular shift of projections 348-1, 348-2 of disk 347*a* relative to the projections 348-3 and 348-4 by 90°. The disks are isolated from each other by ceramic spacers (not shown). In FIG. 11, reference numerals 348*a*, 348*b*, 348*c*, and 348*d* designate the respective gaps shown in FIG. 10, and reference numeral 354*a* and 354*b* designate electric resistors.

In each lens the absolute value of the potential difference between each pair of diametrically opposite poles is equal to 40 V (i.e., [−20V+(−20V)]. Furthermore, in each subsequent lens in the direction of propagation of the ions the potential in the center of the lens will be reduced. It is well known that in an electric field charges s move in the direction of the field gradient. Therefore in the aforementioned helical electrostatic quadrupole field, the ions will move along helical trajectories. Such trajectories are well known for movement of electrons in electron cyclotron resonance (ECR) as well as in the Penning plasma. However, in ECR and in the Penning plasma, the aforementioned helical movement of electrons has an entirely different physical nature and is caused by the drift of the charge in a magnetic field. In the invention, however, the helical trajectory of positively-charged ions results from a specific structure of the electric field in the absence of the magnetic field. Therefore, the aforementioned helical movements should not be confused.

Since the potential on the first lens 348 is negative, on its way in the propagation direction the positively charged ion will be first accelerated by being attracted due to the negative potential on the lens 348. Such acceleration will be continued for a predetermined point on the path of the ion. However, in the course of its continuing movement, the ion will experience the pulling force developed by negative potentials of those lenses, which are left behind the ion. These forces will pull the ion back towards the ionization device 26 (FIG. 6) and thus will gradually decelerate the ion. It also should be noted that the forces acting on all ions will be the same for equally charged ions. However, since ions of different substances have different masses, those ions which have low masses will fly through the spiral quadrupole optics 270 for a shorter time than those ion that are heavier. This is the so-called time-of-flight principle used for identification of ions in time-of-flight type mass spectrometers. As has been described earlier in the review of the prior art technique, it is also known that resolution capacity of time-of-flight mass spectrometers is directly proportional to the length of the trajectory of ions in the analyzer (in our case, in the spiral quadrupole optics 270). Therefore, by causing the ions to move along the helical trajectory, it becomes possible to significantly increase the path of ions through the spiral quadrupole optics 270 and to correspondingly increase the resolution capacity of the spiral quadrupole optics 270.

Figure 12:
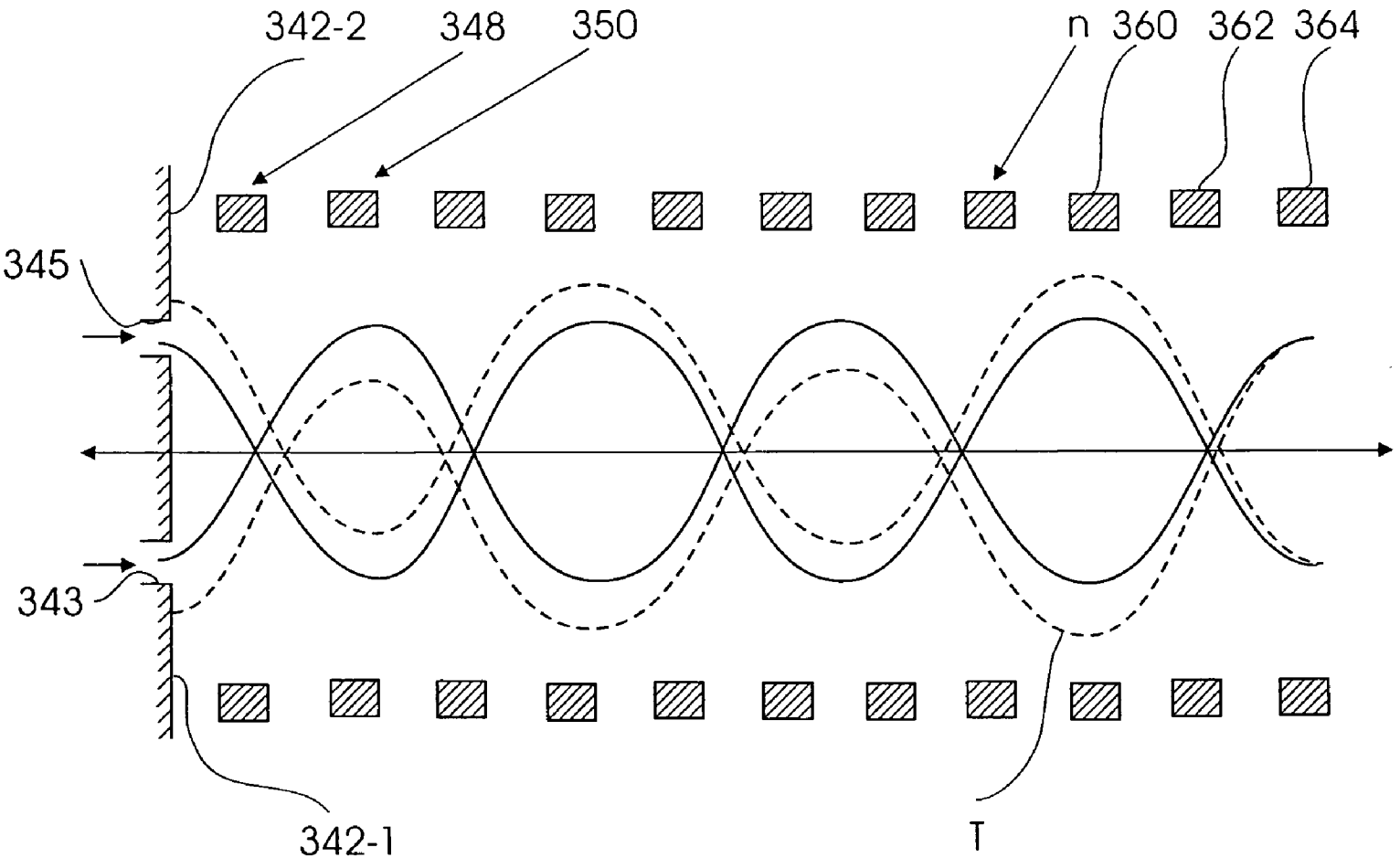
FIG. 12 illustrates two possible trajectories of charged particles at a specific distribution of the electrostatic potentials on the electrostatic lenses of the spiral quadrupole optics of the invention.

FIG. 12 illustrates two possible trajectories of charged particles at a specific distribution of the electrostatic potentials on the electrostatic lenses of the spiral quadrupole optics 270 of the invention. On its way in the direction of propagation the ion reaches a point $\mathbf{0}_1$ in which its velocity in the Z-axis direction becomes equal to 0 due to the forces pulling the ion back to the ionization device 26 (FIG. 6). In this point of the trajectory the ion reverses its direction and begins to move back towards the ionization device 26. In principle, the point of return can be located at a significant distance from the first lens 348, especially for light ions. Therefore, in order to enhance the retardation force, the spiral quadrupole optics 270 is provided with a reflectron R that consists, e.g., of electrostatic mirrors 360, 362, . . . and 364 (FIGS. 6, 7, 12) coaxial with the quadrupole lenses 348, 350, . . . and arranged after the last lens in the ion propagation direction. Each such mirror comprises a continuous ring with a positive potential applied from a power source 366 (FIG. 7). The mirrors 360, 362, 364 are provided with a potential adjustment means, e.g., by adjusting the voltage on the power source 366. A separate device may be used for improving reflection efficiency.

In contrast to the mass spectrometer disclosed in the aforementioned previous patent application, the spiral quadrupole optics 270 has a simplified construction as it does not use magnetic mirrors, which are present in the previous construction. Such elimination of magnetic fields excludes drift of the particles at the zone of reverse. Therefore, return trajectories of the particles that are reflected only from the electrostatic mirrors 360, 362, and 364 should theoretically coincide with the trajectories in the direction of propagation from the point of injection 340. In reality, however, some factors may affect the charged particles in their return path. The main of these factors is aberrations of the spiral quadrupole optics 270. Thus, the return path will not coincide with the direct path but will be located close to the direct path, and the charged particles that flow in the return direction will collide with detectors 342-1 and 342-2 in the zone around the injecting openings 343 and 345 (FIGS. 5 and 12) within the radial distance of several millimeters, or so, depending on real dimensions of elements of the TOF MS 32.

In other words, the charged particles D injected into the spiral quadrupole optics 270 will flow along their respective individual helical paths with speeds that depend on the mass/charge ratio and will be reflected at different points in the space within the limits of the electrostatic mirrors 360, 362, and 364 (FIGS. 6, 7, 12). Positions of the points of reverse will depend on the initial energy of the charged particles and are regulated by the electrostatic mirror. Thus, on their return paths the particles of the same ion beam current pulse will hit the respective micro-channel plate detectors 342-1 and 342-2 in different points and at different times near the injection opening. It is understood that the charged particles that have been injected into the spiral quadrupole optics 270 through a respective injection opening of the micro-channel plate detector will return to the surface of the same detector.

The charged particles incident on the micro-channel plate detector knock out secondary electrons from the surface of the detector, and the moment of the collision will be registered as a pulse on the output of the respective micro-channel plate detector. In contrast to earlier U.S. patent application Ser. No. 10/058,153, in the system of the present invention the position in which the charged particles collide with the micro-channel plate detectors is of no interest for the analysis, and the only information need for the analysis is the time of collision and the magnitude of the pulse that may contain information about the M/Z ratio for the particles being registered. In other words, the detector plates 342-1 and 342-2 will detect only the integral current, and the intensity of this current and time between the pulses will characterize the M/Z ratio and concentration of the components being sought. Accurate detection of collision time is possible due to extremely high-resolution capacity of these devices. In other words, the spiral quadrupole optics 270 of the present embodiment makes it possible to identify charged particles of different masses that flow along different trajectories simultaneously and in the same space. The above trajectories are initiated from different injectors. In the illustrated embodiment, these injectors are inlet or injection ports 343 and 345 of the TOF MS 32 (FIGS. 6 and 12). Exactly this feature of the TOF MS 32 of the invention makes it possible to realize the device of the invention in the form suitable for operation in a high-duty mode up to 98% of the duty cycle. This is the theoretically maximum possible duty cycle unattainable with any other device or method known in the art.

It should be note that, in contrast to a single flow of charge particles through the mass spectrometer of the aforementioned previous patent application, the aerosol TOF MS 32 may have several simultaneous flows of charged particles. For simplicity of the description and drawings, only two such flows are considered in the present application. So, the aforementioned description of the single flow given above is true with regard to the second flow. In particular, as has been shown in FIG. 5, under the effect of the deflector-modulator 239, the flows F1 and F2 of the particles will be injected in alternating mode to different inlet diaphragms 256 and 258 in the barrier 260 between an MS vacuum chamber 262 and a TOF-MS drift tube 264.

Thus, the TOF MS 32 operates in a continuous high-duty mode up to 98% produces an extensive data file. This data is processed and analyzed with the use of a data processing and analyzing system 36 shown in the form of a block diagram in lower part of FIG. 5.

An important part of the system 36 is a (pseudo-random binary sequences (PRBS) generator 402 that generates a $2^{n-1}$ long code structured as a sequence of digital words or sequences that are finite, digital approximation of "white noise". The techniques for generating pseudo-random codes are well known in communication but a real controller for this device has some difference related to the objects of the present invention to develop a duty cycle close to 100%, where 0 is a non-discarding message for modulation. In result, the pulse duration and space between two adjacent pulses don't have much difference in time. Since the duration of each bunching pulse used for the deflector-modulator 239 (FIGS. 1 and 5) is supposed to exceed the trailing edge's period but simultaneously to be as short as possible and compatible with the hardware of the aerosol TOF MS 32, the minimum pulse spacing is chosen equal to 3 μsec with the pulse duration in the range 1 μsec. Preferably, the pulses in the sequence are randomly modulated in such a manner that no two adjacent selected pulses in the sequence are wider apart than 110% of the narrowest space between them. This is achieved by means of the elements of the data processing and analyzing system 36 described below.

Figure 13:
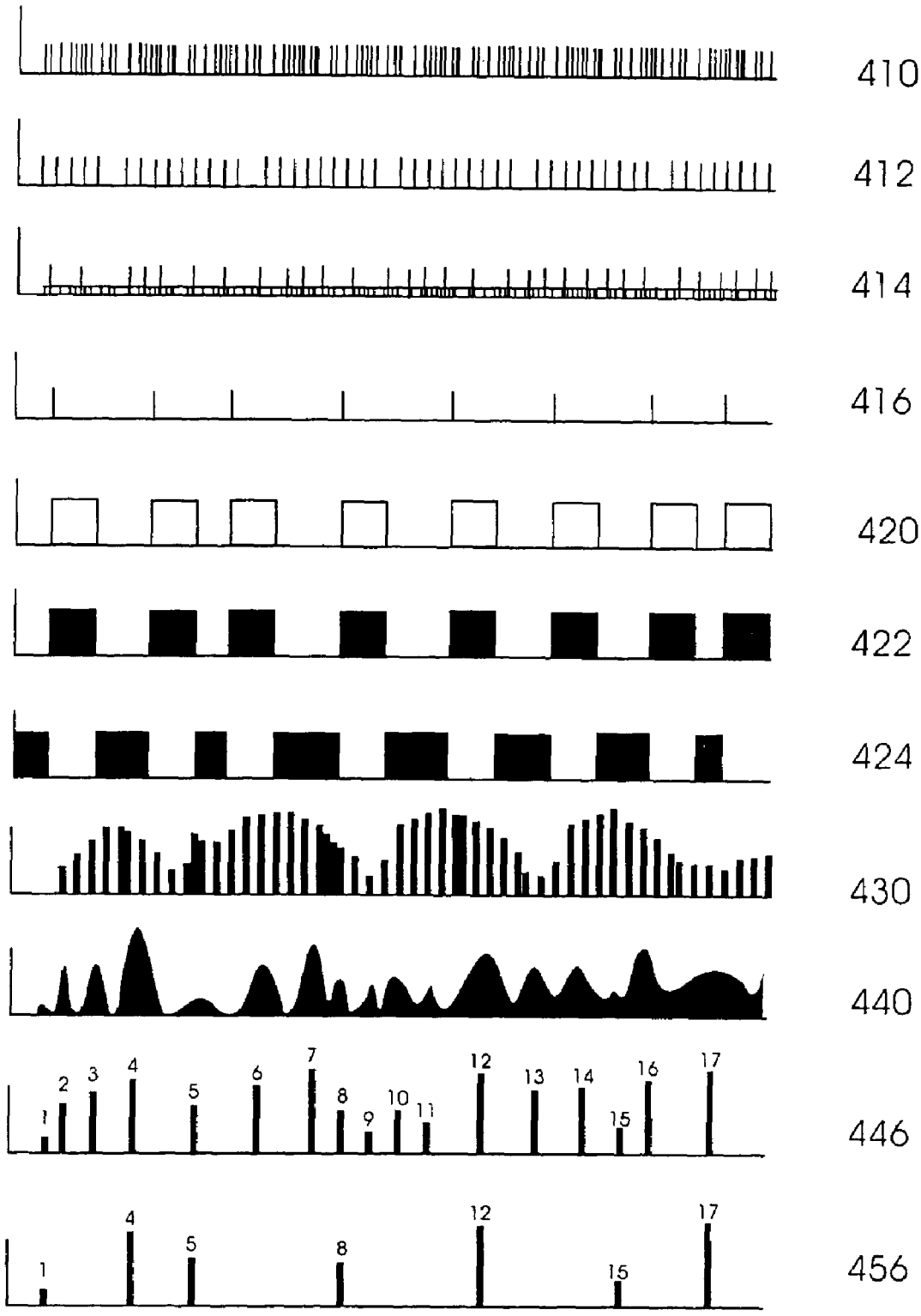
FIG. 13 is a graph illustrating trains of pulses at different stages of mass-spectrometry analysis in the TOF MS of the present invention.

One important group of components in the above system consists of the following sequentially arranged components: a clock generator 404, a trigger or N-times divider 406, the PRBS generator 402, and a dividing system 408. The clock generator 404 generates the clock ticks 410 that are supposed to trigger the PRBS generator 402 (FIG. 1 and FIG. 7) via a trigger 406 by means of a train of pulses 412. The sequence of trains of pulses generated by the components of the system 36 is shown in FIG. 13. If the clock of 100 MHZ is used, the length of a clock tick is 1 second/100 pulses i.e., 10 ns. The length of this pseudo-irregular sequence is supposed to be equal the time of flight of the heaviest ion in the ion packet in the mass spectrometer, for example, 80 μsec. So the clock ticks 410 have to be divided down to approach to this length of sequence. The PRBS generator 402 selects from the divided down clock ticks 412 a pseudo-irregular sequence that controls the deflector-modulator 239 (FIG. 5). If the approximate acquisition period is chosen equal 80 μsec, there are 8,000 clock ticks 410 during this period. Therefore, the clock 404 is connected to the PRBS generator 402 (e.g., of the type Xilinx XC4005XL produced by Xilinx Corporation, San Jose, Calif., USA) to generate the pseudo-irregular sequence of bursts at a rate of 25 MHz through the N-times divider 406 to drive the PRBS generator 402. Herein, N is the factor for dividing down the clock rate to achieve the desired pseudo-noise generator rate. If N is equal 4, the acquisition time around 80 μsec will request the PRBS that is equal to P/N (i.e., 2047) binary events long. The PRBS generator 402 produces on its output a sequence of bursts 414 that consists of 1024 bursts (the number of bursts is always a power of two), and the acquisition time in the acquisition period will be 2047×4×10 ns, i.e., 81.2 μsec. Because the sequence is too fast, only a subset of the bursts of the pseudo-irregular sequence is used to generate the train of the bunching pulses during each acquisition period. So the sequence 414 of the 1024 random bursts is supposed to be grouped in the M groups with Q bursts in each group. Just one from Q bursts in the random temporal position is random selected to trigger a bunching pulse with duration 1 μsec for directing ion packets in two channels of the aerosol TOF MS 32. In this case, Q is selected such that it cannot divide 1024 without leaving a remainder and is determined to be 49. Due to the fact that the divider is 64, the average M is 20.89.

An output of the divider 408 is connected to an input of the aforementioned random-pulse generator 250 (FIG. 5). After being limited by the dividing system 408, the pseudo-random sequence 416 of bursts can trigger the generation of a train 420 of pulses by the aforementioned generator 418 with the random number 20 or 21 bunching pulses with the random deviation of spacing 0.49 μsec inside same acquisition period. So, the train 420 of 20 or 21 bunching pulses with duration 1 μsec and range of spacing 2.5–3 μsec switches through switcher 246 the deflector-modulator 239 (FIG. 5) to direct the ion packets one by one in the different channels. The switcher 246 turns on the power supply 248, if the pulse (P) is present and turns it off, if the pulse is absent (sampling window—SW). In other words, the switcher 246 operates in a mode of a random width-pulse modulation. According to irregular sequence of the pulses, the flow of charged particles changes its path from initial path F1 to the second position F2 with a permanent deflection by the power supply during the sampling window (SW). In both cases, all parts of the stream of particles (F1 and F2) are involved in the analysis by the data acquisition and analysis system 36.

Thus, the SW part is directed in the space of the deflector-modulator 239 that in one of the particle paths directs the flow of charged particles in the aperture of the diaphragm 258. The P part is directed in the space of the deflector-modulator 239 that in the next turn directs the flow in the aperture of the diaphragm 258. This means that the pulse sequence 420 looks like a constant-speed sequence with a certain time jitter on the position of the pulses. This jitter is what now carries the "randomness" of the sequence, as opposed to missing pulses (i.e. large gaps between pulses if one pulse is missed is supposed to be overlapped by a new random distribution). Controlled by this train 420 of bunching pulses with the pseudo-random sequence, the detector-modulator 239 is chopping the continuous stream of particles D. But instead of discarding a part of the particle flow, the detector-modulator 239 just changes the angular positions of the particle flow by alternating it between the diaphragm 256 and 258. Now two discontinuous particle stream F1 and F2 of the ionized packeted particles will pass through the respective diaphragm 256 and 258 with irregular spacing between the packets. The pulses that correspond to the aforementioned flows F1 and F2 with irregular spacing are shown in FIG. 13 as a trains of pulses 422 and 424.

After passing though the flight area, the charged particles D of the two adjacent packets in each F1 and F2 will be reflected by the aforementioned reflectron R and will return back in the direction towards the injectors 343 and 345 approximately along the same trajectory. At the end of their return trajectories, the particles will hit the respective detectors 342-1 or 342-2 that will develop overlapping signals 422 and 424, which are amplified by respective amplifiers 426 and 428 (FIG. 7). The trains of the overlapped amplified signals are shown in FIG. 7 as trains 430 and 432, respectively. Overlapping occurs because the light masses of the second packet of each channel will be represented in the output signal from the detector earlier than heavy masses of first packet, which will come with a certain delay. An example of one of the overlapped signals is designated in FIG. 13 by reference numeral 430.

The system 36 contains a dual channel multiscaller 434, which is connected to the outputs of amplifiers 426 and 428, and from the amplifiers the overlapped signals 430 and 432 are then analyzed by the dual channel multiscaller 434 that detect the spectra of individual packets in each channel. One of the channels of the dual channel multiscaler 434 is connected to a correlator 436, while the other of the channels is connected to a correlator 438. The signals of the dual channel multiscaler are supposed to be correlated with the signal 420 from the random pulse generator 250 (FIGS. 7) in order to inform about the real mass distribution in each channel. The correlation takes place if each channel of the multiscaller 434 is connected simultaneously with the random pulse generator 250 through the correlators 436 and 438. The correlators 436 and 438 provide deconvolution of the detector signals 430 and 432 from the multi-channel plates (detectors) 342-1, 342-2, the amplifiers 426, 428, and the pseudo-random pulse sequence generator 250 modulated by the pseudo-random noise code. The deconvolution establishes a non-overlapping trains 440 and 442, one of which (440) is shown in FIG. 13.

Thus, the aforementioned deconvolution establishes a single demodulated data. The launching sequence and output signal are then shifted in time relative to each other by a predetermined amount to establish a new element-by-element correspondence. Again, the corresponding integer elements are multiplied and the multiplicands are summed to obtain a second demodulated data element. Since the data are processed independently in each channel and since overlapping of the signals in each channel is eliminated, it becomes possible to significantly increase the performance capacity of the aerosol TOF MS 32 with the duty cycle up to 98%. This is because the aerosol TOF MS 32 will not work only during the time required for switching (i.e., the continuity of operation of the spectrometer will be interrupted only for 2% of the operation time).

The pulses from the detectors 342-1, 342-2 do not have a Gaussian shape but typically have short rise-times, much longer fall-times (tails), and varying amplitudes that are supposed to be separated and calculated. The intricate mathematics have to be used to separate adjacent charged-particle lines that have less than one pulse separation. The noise as a result of the low level contamination, i.e., stray charged particles, unstable charged particles exhibiting secondary fragmentation, dark current of the detector, tales of the correlation function, etc., may reduce readability of the meaningful signals. So, two channels are used not only to increase a duty cycle but also to improve the readability of the meaningful signal at the noise level. Therefore, the meaningful signal to useless noise ratio can be much more improved by the second correlation between the demodulated signals from these both channels. Therefore, correlators 436 and 438 from every channel are connected to each other through a second-level correlator 444 responsible for the second deconvolution. As can be seen from FIG. 7, the correlator 444 is located between the first-level correlators 436 and 438. The noise that is not correlated with the signals and with itself is supposed to be suppressed. The influence of the stray charged particles in two channels is also not correlated. The result of this deconvolution is the Gaussian shape of each line amplitude that can be distinguished and calculated more accurately. The output of the second deconvolution is a composition of the mass spectrum 447, which is shown in FIG. 13, while the train of pulses on the output of the second-level correlator 444 is shown in FIG. 7. The histogram 446 (FIG. 13) contains a spectrum of different M/z ratios and other useful information. The width of the Gaussian-shape picks on the oscillogram 440 (FIG. 13) is responsible for mass resolution and can serve simultaneously as "fingerprints" for quick determination of dangerous species by third deconvolution. Even small picks that were shadowed by the noise before the second deconvolution now can be taken in account as fingerprints increasing sensitivity of the device. So, the aerosol TOF MS 32 of the invention generates the aforementioned data histogram 446 (FIG. 13) using the notation [m/z; abundance]. This data histogram provides a fragmentation pattern, for example, as: $[M_1/z; I_1]$ $[M_2/z; I_2]$ $[M_3/z; I_3]$ $[M_4/z; I_4]$ $[M_5/z; I_5]$:

The third deconvolution process is intended for filtering the unnecessary data. This is achieved by identifying the compounds during monitoring of known spectra stored in the memory of the data acquisition system 36 by comparing this data with the data stored in the electronic data bank. For this purposes, the data acquired by the system 36 are first deconvoluted by means of a correlator 450 at a rate that meets or exceeds the spectrum acquisition rate of the TOF MS 32. This type of deconvolution (i.e. deconvolution of spectral data at least as fast as a mass spectrometer can create a spectral information) is called "on-the-fly" deconvolution. To accommodate deconvolution on-the-fly, it is important that the exemplary deconvolution process be capable of distinguishing relevant and irrelevant deconvolution results. So the data histogram 446 from the second deconvolution correlator 444 provided as the output of the TOF MS 32 is presented against a current deconvolution compound library 452 (FIG. 7) that contains a set of deconvolution compounds 454, and each such compound has its own fingerprint set of M/z ratio and abundance values.

Thus, it has been shown that the invention provides an aerosol time-of-flight mass (TOF MS) spectrometer which is suitable for continuous operation in a high-duty mode, divides a single flow of particles at the TOF MS input into a plurality of independent flows that are analyzed without mutual interference, combines in itself such features as a reasonable cost, high performance characteristics, simple construction, and high resolution capacity, allows improved sensitivity and resolution capacity of analysis, and operates in real time with convenient presentation of data for analysis. The invention also provides a method of mass spectroscopy that can be carried out continuously in a high-duty mode with division of a single flow of particles into a plurality of flows of distinctly detectable particles that fly along different trajectories simultaneously and in the same confined space.

Although the invention has been shown and described with reference to specific embodiments, it is understood that these embodiments should not be construed as limiting the areas of application of the invention and that any changes and modifications are possible, provided these changes and modifications do not depart from the scope of the attached patent claims. For example, the flow of particles that is received from the ionization device can be divided by the deflector-modulator into more than two separate flows that can fly through the drift tube of the TOF MS simultaneously and analyzed irrespective from each other. For this purpose, the TOF MS will have more than two inlet ports and more than two respective detectors. The number of quadrupole electrostatic lenses may be different from nine. The quadrupole lenses in the series can be angularly shifted not-necessarily to equal angles. For example, in each subsequent lens the shift angle may be increased. Lenses with angular shift can alternate with lenses without angular shift. The diameter of quadrupole lenses may decrease or increase in the direction of propagation and can be inscribed into a conical surface. The lenses can be axially spaced at difference distances. The mass spectrometer can be used without circular electrostatic mirrors. The particles will move along any given spatial trajectory, not necessarily helical.

The invention claimed is:

1. An aerosol time-of-flight mass spectrometer comprising:

an elongated sealed vacuum chamber having an axial direction with a central longitudinal axis, said elongated sealed vacuum chamber having an input side and an opposite side, said input side having at least two inlet ports for admission to said elongated sealed high-vacuum chamber of at least two flows of charged particles of a substance to fly through said elongated sealed vacuum chamber simultaneously and independently of each other;

electrostatic field generation means for generating an electrostatic field in said an elongated sealed vacuum chamber for causing charged particles that entered said elongated sealed high-vacuum chamber through said at least two inlet ports to fly along different curvilinear trajectories in a direct path from said input side towards said opposite side and in a return path from said opposite side to said input side; and a charged particle detector means for detecting times of collisions of said charged particles with said charged particle detector means for determining the time of flight of said charged particles independently for each of said at least two flows, said charged particle detector means being located in the vicinity of said at least two inlet ports and generating collision signals at the moments of said collisions.

2. The aerosol time-of-flight mass spectrometer according to claim 1, wherein said electrostatic field generation means comprise:

a plurality of quadrupole electrostatic lenses which are arranged in series and coaxially in said direction from said input side to said opposite side, each of said quadrupole electrostatic lenses comprising a circular body formed by four arch-shaped poles located substantially in a common plane perpendicular to said central longitudinal axis and arranged circumferentially about said central longitudinal axis in the form of a first pair composed of two diametrically opposite and electrically connected poles and a second pair composed of two diametrically opposite and electrically connected poles, in each of said quadrupole electrostatic lenses said poles being angularly shifted with respect to said poles of a quadrupole electrostatic lens subsequent in said direct path by a selected angle in order to provide said angular gradient of the electrostatic field between adjacent quadrupole lenses of said plurality and thus to cause said charged particles to move along said curvilinear trajectories; and mirror means comprising: an electrostatic mirror located on said opposite side for reflecting said charged particles in a return direction opposite to said direction from said input side to said opposite side for dividing said curvilinear trajectories into a direct section for movement of said charged particles in said direction from said input side to said opposite side and a return section for movement of said charged particles in a direction from said opposite side to said input side.

3. The aerosol time-of-flight mass spectrometer according to claim 1, further comprising charged-particle deflection means located in front of said at least two inlet ports in the direction from said input side to said opposite side, said charged-particle deflection means comprising: a flow deflection unit for dividing in an alternating mode a single flow of charged particles received by said charged-particle deflection means into said at least two flows of charged particles;

a steering unit for correcting trajectories of said at least two flows of charged particles for directing them to said at least two inlet ports; and random pulse modulation means connected to said charged-particle deflection means for generating irregular sequence of said charged particles in said at least two flows.

4. The aerosol time-of-flight mass spectrometer according to claim 2, further comprising charged-particle deflection means located in front of said at least two inlet ports in the direction from said input side to said opposite side, said charged-particle deflection means comprising: a flow deflection unit for dividing in an alternating mode a single flow of charged particles received by said charged-particle deflection means into said at least two flows of charged particles; a steering unit for correcting trajectories of said at least two flows of charged particles for directing them to said at least two inlet ports; and random pulse modulation means connected to said charged-particle deflection means for generating irregular sequence of said charged particles in said at least two flows.

5. The aerosol time-of-flight mass spectrometer according to claim 4, wherein said flow deflection unit comprises a first electrode plate and a second electrode plate spaced from said first electrode plate, said first electrode plate being connected to a first power supply that provides deflection of said single flow of charged particles by an angle $\alpha$ towards one of said at least two inlet ports, said second electrode plate being connected to a second power supply via a switching unit that provides deflection of said single flow of charged particles by an angle $2\alpha$ towards another of said at least two inlet ports.

6. The aerosol time-of-flight mass spectrometer according to claim 5, wherein said steering unit comprises a third electrode plate connected to a source of a permanent potential, a fourth electrode plate connected to a source of a permanent potential, and a fifth grounded electrode located between said third electrode and said fourth electrode, one of said at least two flows of charged particles being directed to one of said at least two inlet ports via a space between said third plate electrode and said fifth grounded electrode, while another of said at least two flows of charged particles being directed to another of said at least two inlet ports via a space between said fourth plate electrode and said fifth grounded electrode.

7. The aerosol time-of-flight mass spectrometer according to claim 4, wherein said flow deflection unit comprises a first electrode plate and a second electrode plate spaced from said first electrode plate, said first electrode plate being connected to a first power supply that provides deflection of said single flow of charged particles by an angle $\alpha$ towards one of said at least two inlet ports, said second electrode plate being connected to a second power supply via a switching unit that provides deflection of said single flow of charged particles by an angle $2\alpha$ towards another of said at least two inlet ports.

8. The aerosol time-of-flight mass spectrometer according to claim 7, wherein said steering unit comprises a third electrode plate connected to a source of a permanent potential, a fourth electrode plate connected to a source of a permanent potential, and a fifth grounded electrode located between said third electrode and said fourth electrode, one of said at least two flows of charged particles being directed to one of said at least two inlet ports via a space between said third plate electrode and said fifth grounded electrode, while another of said at least two flows of charged particles being directed to another of said at least two inlet ports via a space between said fourth plate electrode and said fifth grounded electrode.

9. The aerosol time-of-flight mass spectrometer according to claim 2, wherein said selected angle is equal to 360° divided by the number of quadrupole electrostatic lenses in said plurality.

10. The aerosol time-of-flight mass spectrometer according to claim 9, wherein said curvilinear trajectories are helical trajectories.

11. The aerosol time-of-flight mass spectrometer according to claim 2, further comprising: a first power source having a negative terminal, a positive terminal, and a midpoint between said negative terminal and said positive terminal; and a second power source having a negative terminal and a positive terminal; said first pair of two diametrically opposite poles being connected to said positive terminal of said first power source via a first resistor, said second pair of two diametrically opposite poles being connected to said negative terminal of said first power source, said midpoint of said first power source being connected to said negative terminal of said second power source via a second resistor, said positive terminal of said second power source being grounded, said second power source generating a current of a high voltage which is higher than voltage of said first power source; said high voltage decreasing from one quadrupole electrostatic lenses to another quadrupole electrostatic lenses in said direct path.

12. The aerosol time-of-flight mass spectrometer according to claim 10, further comprising: a first power source having a negative terminal, a positive terminal, and a midpoint between said negative terminal and said positive terminal; and a second power source having a negative terminal and a positive terminal; said first pair of two diametrically opposite poles being connected to said positive terminal of said first power source via a first resistor, said second pair of two diametrically opposite poles being connected to said negative terminal of said first power source, said midpoint of said first power source being connected to said negative terminal of said second power source via a second resistor, said positive terminal of said second power source being grounded, said second power source generating a current of a high voltage which is higher than voltage of said first power source; said high voltage decreasing from one quadrupole electrostatic lenses to another quadrupole electrostatic lenses in said direct path.

13. The aerosol time-of-flight mass spectrometer according to claim 7, further comprising: a first power source having a negative terminal, a positive terminal, and a midpoint between said negative terminal and said positive terminal; and a second power source having a negative terminal and a positive terminal; said first pair of two diametrically opposite poles being connected to said positive terminal of said first power source via a first resistor, said second pair of two diametrically opposite poles being connected to said negative terminal of said first power source, said midpoint of said first power source being connected to said negative terminal of said second power source via a second resistor, said positive terminal of said second power source being grounded, said second power source generating a current of a high voltage which is higher than voltage of said first power source; said high voltage decreasing from one quadrupole electrostatic lenses to another quadrupole electrostatic lenses in said direct path.

14. The aerosol time-of-flight mass spectrometer according to claim 1, wherein said charged particle detector means comprise a first micro-channel plate detector which is aligned with one of said at least two inlet ports and a second micro-channel plate detector which is aligned with another of said at least two inlet ports, said first micro-channel plate detector having an opening aligned with said one of said two inlet ports for passing one of said at least two charged particles flows into said elongated sealed high-vacuum chamber, and said second micro-channel plate detector having an opening aligned with the other of said two inlet ports for passing the other of said at least two charged particles flows into said elongated sealed high-vacuum chamber.

15. The aerosol time-of-flight mass spectrometer according to claim 2, wherein said charged particle detector means comprise a first micro-channel plate detector which is aligned with one of said at least two inlet ports and a second micro-channel plate detector which is aligned with another of said at least two inlet ports, said first micro-channel plate detector having an opening aligned with said one of said two inlet ports for passing one of said at least two charged particles flows into said elongated sealed high-vacuum chamber, and said second micro-channel plate detector having an opening aligned with the other of said two inlet ports for passing the other of said at least two charged particles flows into said elongated sealed high-vacuum chamber.

16. The aerosol time-of-flight mass spectrometer according to claim 13, wherein said charged particle detector means comprise a first micro-channel plate detector which is aligned with one of said at least two inlet ports and a second micro-channel plate detector which is aligned with another of said at least two inlet ports, said first micro-channel plate detector having an opening aligned with said one of said two inlet ports for passing one of said at least two charged particles flows into said elongated sealed high-vacuum chamber, and said second micro-channel plate detector having an opening aligned with the other of said two inlet ports for passing the other of said at least two charged particles flows into said elongated sealed high-vacuum chamber.

17. The aerosol time-of-flight mass spectrometer according to claim 2, wherein said electrostatic mirror means comprise at least one electrostatic mirror coaxial with said quadrupole electrostatic lenses and located after the last quadrupole electrostatic lens in said charged particle propagation direction.

18. The aerosol time-of-flight mass spectrometer of claim 17, wherein said at least one electrostatic mirror comprises a continuous ring with a positive potential applied from a power source, said at least one electrostatic mirror being provided with a potential adjustment means.

19. The aerosol time-of-flight mass spectrometer according to claim 12, wherein said electrostatic mirror means comprise at least one electrostatic mirror coaxial with said quadrupole electrostatic lenses and located after the last quadrupole electrostatic lens in said charged particle propagation direction.

20. The aerosol time-of-flight mass spectrometer of claim 19, wherein said at least one electrostatic mirror comprises a continuous ring with a positive potential applied from a power source, said at least one electrostatic mirror being provided with a potential adjustment means.

21. The aerosol time-of-flight mass spectrometer according to claim 15, wherein said electrostatic mirror means comprise at least one electrostatic mirror coaxial with said quadrupole electrostatic lenses and located after the last quadrupole electrostatic lens in said charged particle propagation direction.

22. The aerosol time-of-flight mass spectrometer of claim 21, wherein said at least one electrostatic mirror comprises a continuous ring with a positive potential applied from a power source, said at least one electrostatic mirror being provided with a potential adjustment means.

23. The aerosol time-of-flight mass spectrometer according to claim 14, wherein said mirror means comprise at least one electrostatic mirror coaxial with said quadrupole electrostatic lenses and located after the last quadrupole electrostatic lens in said charged particle propagation direction.

24. The aerosol time-of-flight mass spectrometer of claim 23, wherein said at least one electrostatic mirror comprises a continuous ring with a positive potential applied from a power source, said at least one electrostatic mirror being provided with a potential adjustment means.

25. The aerosol time-of-flight mass spectrometer of claim 2, further provided with a data acquisition and processing unit having means for analysis of mass distribution of said charged particles on the basis of said collision signals, said means for analysis having two independent processing channels for processing collision signals obtained independently for charged particles of each of said at least two flows, a correlator means for deconvolution of said collision signals for establishing a non-overlapping trains of deconvoluted signals, and means for increasing a duty cycle of said aerosol time-of-flight mass spectrometer due to overlapping of said deconvoluted signals in said two independent processing channels.

26. The aerosol time-of-flight mass spectrometer of claim 14, further provided with a data acquisition and processing unit having means for analysis of mass distribution of said charged particles on the basis of said collision signals, said means for analysis having two independent processing channels for processing collision signals obtained independently from said first micro-channel plate detector and from said second micro-channel plate detector, a correlator means for deconvolution of said collision signals for establishing a non-overlapping trains of deconvoluted signals, and means for increasing a duty cycle of said aerosol time-of-flight mass spectrometer due to overlapping of said deconvoluted signals in said two independent processing channels.

27. The aerosol time-of-flight mass spectrometer of claim 15, further provided with a data acquisition and processing unit having means for analysis of mass distribution of said charged particles on the basis of said collision signals, said means for analysis having two independent processing channels for processing collision signals obtained independently from said first micro-channel plate detector and from said second micro-channel plate detector, correlator means for deconvolution of said collision signals for establishing a non-overlapping trains of deconvoluted signals, and means for increasing a duty cycle of said aerosol time-of-flight mass spectrometer due to overlapping of said deconvoluted signals in said two independent processing channels.

28. A method of mass spectrometry with the use of an aerosol time-of-flight mass spectrometer that receives a flow of charged particles for analysis, said mass spectrometer having an input side and an opposite side opposite to said input side, particle collision detection means on said input side, and data acquisition and processing means, said method comprising the steps of:

dividing said flow of charged particles into at least two flows of charged particles;

subjecting said charged particles in said at least two flows to random pulse modulation for generating irregular sequence of said charged particles in said at least two flows;

generating an electrostatic field in said mass spectrometer for directing said charged particles of said at least two flows along at least two predetermined non-linear trajectories in a direct path from said input side to said opposite side and reflecting said charged particles in a return path from said opposite side to said input side;

detecting times of collision of said charged particles with said particle collision detection means independently for particles of each of said at last two flows; generating and measuring collision detection signals that result from said collision independently for charged particles of each of said at least two flows and analyzing mass distribution of said charged particles of each of said at least two flows on the basis of said collision detection signals.

29. The method of claim 28, further comprising the steps of:

deconvoluting said collision detection signals for establishing a non-overlapping trains of deconvoluted signals, and increasing a duty cycle of said aerosol mass spectrometer by overlapping said deconvoluted signals that correspond to said at least two flows.

* * * * *